US010676941B1

(12) United States Patent
Hoffman et al.

(10) Patent No.: US 10,676,941 B1
(45) Date of Patent: Jun. 9, 2020

(54) WALL-ATTACHMENT STRUCTURE AND SYSTEM EMPLOYING AN INTRA-STRUCTURAL HINGE FOR REINFORCING PREFERRED PLACEMENT ON A STRAIGHT OR CURVED WALL

(71) Applicants: Jeremy P. Hoffman, Newtown, PA (US); Robert MacMillan, Perkasie, PA (US)

(72) Inventors: Jeremy P. Hoffman, Newtown, PA (US); Robert MacMillan, Perkasie, PA (US)

( * ) Notice: Subject to any disclaimer, the term of this patent is extended or adjusted under 35 U.S.C. 154(b) by 0 days.

(21) Appl. No.: 15/907,044

(22) Filed: Feb. 27, 2018

Related U.S. Application Data

(63) Continuation-in-part of application No. 15/011,474, filed on Jan. 29, 2016, now Pat. No. 9,903,125.

(60) Provisional application No. 62/183,956, filed on Jun. 24, 2015, provisional application No. 62/128,273, filed on Mar. 4, 2015, provisional application No. 62/109,443, filed on Jan. 29, 2015.

(51) Int. Cl.
*E04F 19/04* (2006.01)

(52) U.S. Cl.
CPC .... *E04F 19/0436* (2013.01); *E04F 2019/044* (2013.01); *E04F 2019/0427* (2013.01)

(58) Field of Classification Search
CPC ... E04F 19/0436; E04F 19/04; E04F 19/0427; E04F 19/0459; E04F 19/0486; E04F 2019/0422; E04F 2019/0427; E04F 2019/0431
See application file for complete search history.

(56) References Cited

U.S. PATENT DOCUMENTS 3,200,547 A * 8/1965 Johnson ..... E04F 19/028 206/586
3,207,274 A * 9/1965 Baermann ..... A45C 5/02 150/154
4,052,830 A * 10/1977 Smith ..... E04F 19/04 52/288.1
4,578,905 A * 4/1986 Hout ..... E06B 1/62 49/467

(Continued)

FOREIGN PATENT DOCUMENTS

CH 415009 A 6/1966
CN 202202548 U 4/2012

(Continued)

*Primary Examiner* — Babajide A Demuren
(74) *Attorney, Agent, or Firm* — Clinton H. Wilkinson

(57) ABSTRACT

A unitary longitudinal wall attached structure of consistent profile for installation on a wall having an attachment portion which is securely affixed to the wall, an inherently flexible pivot or hinge portion whose upper end is attached to the attachment portion and whose lower end is attached to a rigid pivoting body whose center of mass is below and spaced outwardly from the wall relative to the hinge portion and gravity when preferably installed, where the wall is angled no more than 45 degrees and is secured to the larger structure within which the wall attached structure is to be installed, with said installation enabling an intra-structural pendulum where the secured attachment portion anchors the pendulum, and the inherently flexible hinge portion enables the pivoting body as it urges its lower contact surface against the wall.

18 Claims, 24 Drawing Sheets

(56) References Cited

U.S. PATENT DOCUMENTS 5,001,877 A * 3/1991 Edwards ..... B44C 5/00 403/295
5,428,929 A * 7/1995 Reese ..... E04F 19/028 52/255
5,433,048 A * 7/1995 Strasser ..... E04B 9/30 52/288.1
5,457,923 A * 10/1995 Logan ..... E04F 19/0436 52/272
5,590,496 A * 1/1997 Martin ..... E06B 1/6015 206/321
5,592,797 A 1/1997 Logan et al.
5,749,512 A * 5/1998 Gingras-Taylor ..... B65D 5/445 206/459.5
6,050,037 A * 4/2000 Gifford ..... E06B 1/62 52/211
6,125,605 A * 10/2000 Young ..... E06B 1/34 52/211
6,148,584 A * 11/2000 Wilson ..... E04F 19/0463 52/211
7,392,625 B2 * 7/2008 Bruggink ..... E06B 1/62 52/204.55
7,958,685 B2 * 6/2011 Rowohlt ..... E04F 19/0436 52/287.1
8,375,660 B2 * 2/2013 Nolan ..... E06B 1/34 52/204.53
2002/0059760 A1 * 5/2002 Heard ..... E06B 1/6015 52/211
2004/0040235 A1 * 3/2004 Kurtz ..... E04F 19/0468 52/288.1
2006/0096203 A1 * 5/2006 Weinstein ..... E04F 19/0463 52/288.1
2009/0013636 A1 * 1/2009 Wilson ..... E04F 19/02 52/718.01
2010/0058690 A1 * 3/2010 Rowohlt ..... E04F 19/0436 52/287.1
2010/0071288 A1 * 3/2010 Jun ..... E04F 19/0468 52/288.1
2013/0278019 A1 * 10/2013 Preisler ..... B60R 5/04 296/193.07

FOREIGN PATENT DOCUMENTS

CN 202810143 U 12/2012
DE 1659736 A1 9/1969
EP 2369092 B1 7/2012

* cited by examiner

WALL-ATTACHMENT STRUCTURE AND SYSTEM EMPLOYING AN INTRA-STRUCTURAL HINGE FOR REINFORCING PREFERRED PLACEMENT ON A STRAIGHT OR CURVED WALL

CROSS-REFERENCE TO PREVIOUS RELATED APPLICATIONS

This application is a continuation-in-part of patent application Ser. No. 15/011,474 filed on Jan. 29, 2016, which claims priority to provisional application No. 62/109,443 filed on Jan. 29, 2015, provisional application No. 62/128,273 filed on Mar. 4, 2015, and also provisional application no. 62/183,956 filed on Jun. 24, 2015, the contents of which are incorporated herein by reference in their entireties.

FIELD OF THE INVENTION

The present invention is directed to systems and methods for installing crown molding in a building, and more particularly to a molding assembly and method of installation that speeds the process and is particularly suited to spaces where walls, and junctions of walls, are imperfect and vary from the true geometric planes that were intended. The present invention is also suited to various applications where the molding may bear weight in addition to its own, such as supporting a suspended ceiling or supporting various electrical equipment.

BACKGROUND OF THE INVENTION

Crown molding is a desirable design element that improves the appearance of interior spaces. Wood crown molding has been used in buildings for many years, and is traditionally installed where there is a fixed ceiling, and at the top of the wall, with the crown molding fastened to both the ceiling and the wall. The crown molding is securely attached to the wall by nailing with nails being passed through the decorative face of the molding into the wall, and, separately, into the ceiling. This installation method, however, leaves holes and marks where the nails travel through the decorative face, requiring patching to regain a smooth surface on the decorative face. Further, installing traditional crown molding where walls meet in the corners of a room is a known carpentry challenge, with precision cuts at difficult to determine angles required. The difficulty of satisfactorily installing traditional crown molding in corners is one of the reasons that installing traditional crown molding is considered one of the most difficult trim work installations.

Traditional wood crown molding is also largely stiff, and has little ability to flex over small longitudinal distances, such as less than one foot, and for small distances will remain very close to straight. However, there is flex with longer longitudinal distances, for example over eight feet. This means that when installed on an imperfect wall, the traditional wood crown will remain preferentially straight, as it is unable to flex over short distances, yet can flex a small amount (a couple inches) over longer distances such as eight feet. The result is a molding that appears straight to the eye, even if it is installed on a wall (and ceiling) with surface irregularities. Traditional wood crown molding that is installed over middle length irregularities (such as a waviness over a distance of one foot as an example) will not be able to flex and tightly follow the wave of the wall, but will remain largely straight against such middle-length waves. This may leave gaps where the molding remains straight against the wave, which gaps are conventionally filled with caulk to obscure the gap. With a properly installed traditional wood crown molding mounted on an irregular wall, the resulting appearance can be of a straight crown molding that draws the eye and deemphasizes the imperfections in the wall.

The present invention improves upon existing crown molding technologies by incorporating the ability to both install tightly and securely to a wall that is not perfectly straight and to maintain a preferentially straight crown molding face as seen in the room. This is accomplished by enabling two specific forms of flex to occur within the molding system; short-scale flex limited to an attachment portion of the molding, and a hinge-like action along the length of the attachment portion between (or incorporated within) the attachment portion and the decorative face, that allows the lower portion of the molding assembly to always achieve its desired location at the wall.

The hinge-like flex, in particular, is an improvement upon the crown molding system and method described in the inventors' recently issued U.S. Pat. No. 8,887,460, which molding is described as a simple pendulum, where the fastener, as it pierces the attachment flange, is above the center of mass of the entire molding system. In this simple pendulum system, the fastener serves as the pivot, and the molding structure as a whole will be constantly urged toward the wall, which is also the desired position of the crown molding. The invention requires the pivot to be at the fastener, and requires the molding to pivot as a whole, with no described accommodations for flex within the molding system that enables the pendulum effect in addition to the pivoting of the entire molding system.

The present invention, by moving the pivot of the simple pendulum system to within the molding structure itself, enables an improved molding system. While the short-scale and hingelike flex actions occur, the structure of the molding is such that the decorative face of the molding is held in its desired position, with its lower portion against the wall and decorative face being held preferentially straight, similar to how traditional wood crown molding remains preferentially straight, even as the attachment portion flexes as needed when secured to an imperfect wall. The result of these improved parameters of flex, which are insulated from the decorative face, is a molding that, similar to traditional wood crown molding, remains primarily straight even as it is securely attached to a wall with irregularities from a perfect plane. Having a straight crown molding mounted to an imperfect wall is a desired design feature, as occupants within a room will have their eyes drawn to the straight crown molding, making the irregular wall less apparent.

The crown molding system and method described in the inventors' U.S. Pat. No. 8,887,460 offers improvements to the process of installing crown molding. However, certain wall irregularities would cause such crown molding system to install in an undesirable fashion. Further, the crown molding has no provisions for separable flex of the attachment portion, causing wall irregularities to be transmitted to the decorative face. This lack of separable flex of the attachment portion of the inventors' patented crown molding system is presented as a feature of the invention, since it allows the crown molding to "follow the uneven contour of the wall." However, the result of a crown molding flexing to match the contours of a wavy wall that is designed to be straight is fundamentally different from the result of the improved invention described here.

The molding described in U.S. Pat. No. 8,887,460 also does not include a hinge-like flex such as in the present inventors' improved crown molding system. Without this hinge effect, the molding described in U.S. Pat. No. 8,887,460 would install over certain irregularities which would force the bottom edge of the molding away from the wall, even though lower edge of the decorative face would still be continually urged against the wall surface. As an example, if the wall has an irregularity which protrudes outside of the wall below the fastener but above the lower edge of the decorative face, this irregularity would force the lower edge of the decorative face away from the wall. The simple pendulum action does urge the lower edge of the decorative face towards the wall, but without a hinge-like action within the molding such as in the present invention, the molding would rest against the protuberance leaving the lower edge of the decorative face away from the wall.

BRIEF SUMMARY OF THE INVENTION

The present invention provides an improved system and method for installation of crown molding that offers ease of installation compared to traditional crown molding installation, and also offers improvements that allow for secure installation of crown molding against a wall that contains irregularities and deviations from the intended plane. The invention comprises an installation portion and a molding portion, where the decorative face of the molding is entirely within the molding portion. The crown molding is installed by securing the attachment portion, which is above the center of mass of the entire molding system, firmly against a wall or vertical surface. The invention permits the attachment portion in some embodiments to flex as needed as it is firmly secured to the wall with its irregularities, without transmitting those irregularities, especially over short distances, to the decorative face. Since some wall irregularities may result in the lower edge of the decorative face being displaced away from the wall, the invention also incorporates a hinge-like flex either within the attachment portion, or at the junction of the attachment portion and the molding portion, which creates a pivot enabling a simple pendulum system that allows the lower edge of the decorative face to fall into place at the wall, constantly urged by gravity acting on the simple pendulum system. The rear of the molding portion may also have a relief space above where the lower portion contacts the wall to prevent any protruding wall irregularities from forcing the lower edge of the decorative face away from the wall.

An additional benefit of the present invention is that with the secure attachment of the installation portion to the wall or vertical surface, and enabling of a pivot and resulting reinforcement of the desired position of the molding portion and decorative face, any additional weight that is born by the molding portion of the system, such as when the molding acts as the perimeter of a suspended ceiling or contains electrical equipment and wiring, will additively reinforce the desired position of the lower edge of the molding portion at the wall. The present invention further improves installation of crown molding at corners where two walls meet. At corners, the invention joins the decorative faces in a single piece at the designed angle. The attachment portions corresponding to each decorative face do not meet at the corner, and are separated by at least a short distance that allows them to each be separately firmly secured to each respective wall close to the corner, and enabling each attachment portion to flex independently of the other and thus more easily absorb irregularities where the walls meet. This invention also offers the improvement that none of the methods of installation, reinforcing, joining different sections or installing corner pieces ever result in piercing or otherwise disturbing the decorative face, while retaining a consistent decorative face profile and shape around the entire installation.

This invention is also capable of being adapted for installation on walls which are not designed to be vertical, such as the walls of an underground tunnel, where the walls onto which the present invention are to be installed are curved, as reflective of a circular bore of the overall tunnel. As long as the center of mass of the molding portion is spaced outwardly from the wall with respect to the hinge within the molding the molding section, when installed, will still be urged into the preferred position, with the lower edge of the molding system urged towards the wall.

Further, there may be instances in which the molding is preferred to be installed onto a separate piece, wherein the separate piece is attached to the wall prior to installation of the crown molding of the present invention. This occurs often in installations of traditional crown molding, where a board is installed on the wall which extends somewhat below the bottom edge of the crown molding, and the crown molding is attached directly to the board, and, therefore attached indirectly to the wall.

Although most embodiments of this invention are described as crown molding, there are embodiments of the present invention which would not be commonly described as crown molding, such as an embodiment within which the decorative face facing the room is devoid of any of the common decorative profile elements commonly found in crown molding, and is a simple flat plane facing the room. Such an embodiment would appear different from most traditional crown moldings, yet would deploy the inventive features described herein. Such as embodiment where the surface facing the room is a simple flat plane could also be used as a mounting surface for a traditional crown molding, wherein the traditional crown molding is glued or otherwise adhered to the simple flat plane which would otherwise face the room, resulting in the inventive structure serving as a support for traditional crown molding, but not as crown molding itself.

The present invention may also be utilized as a support structure for other items which can be useful in the space within which this invention is to be installed. For example standard LED light strips have a natural form factor which is particularly suited for longitudinal narrow form factors, and one or more embodiments of the present invention may be adapted to support LED lighting strips. The present invention may also be purposed to support electrical cables, such as electrical power cables and communications cables.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a perspective view from the rear of the crown molding section shown in

FIG. 1

DETAILED DESCRIPTION OF THE INVENTION

The following detailed description is of the best mode or modes of the invention presently contemplated. Such description is not intended to be understood in a limiting sense, but to be a non-limiting example of the invention presented solely for illustration thereof, and by reference to which in connection with the following description and the accompanying drawings one skilled in the art may be advised of the advantages and construction of the invention. Wherever possible, like reference numbers have been utilized to refer to like elements or features of the invention throughout the different embodiments illustrated herein.

The present molding system is adapted for use with an irregular wall. By irregular wall, what is meant is a wall that has variations from its designed plane (if referring to a curved wall, then variations from that curved design). These variations are known to exist in all walls, even under excellent construction conditions, and may be present in new construction and/or introduced over time due to settling, effects of climate variations, etc. Most commonly, a wall that is designed to be straight for a certain length will always have some unintended variations from a planned geometrically perfect plane.

The molding system of the present invention is designed such that it can be used with irregular walls that are regular enough to pass inspection and be considered acceptable versus the geometrically perfect design, and offer improvements over the current state of the art. When the crown molding of the present invention is mounted to an irregular wall, the mounting is securely attached, yet the decorative face is preferentially straight even as the non-visible components of the molding system, such as the attachment portion, absorb the flex required to firmly mount the molding system to said irregular wall.

Figure 1:
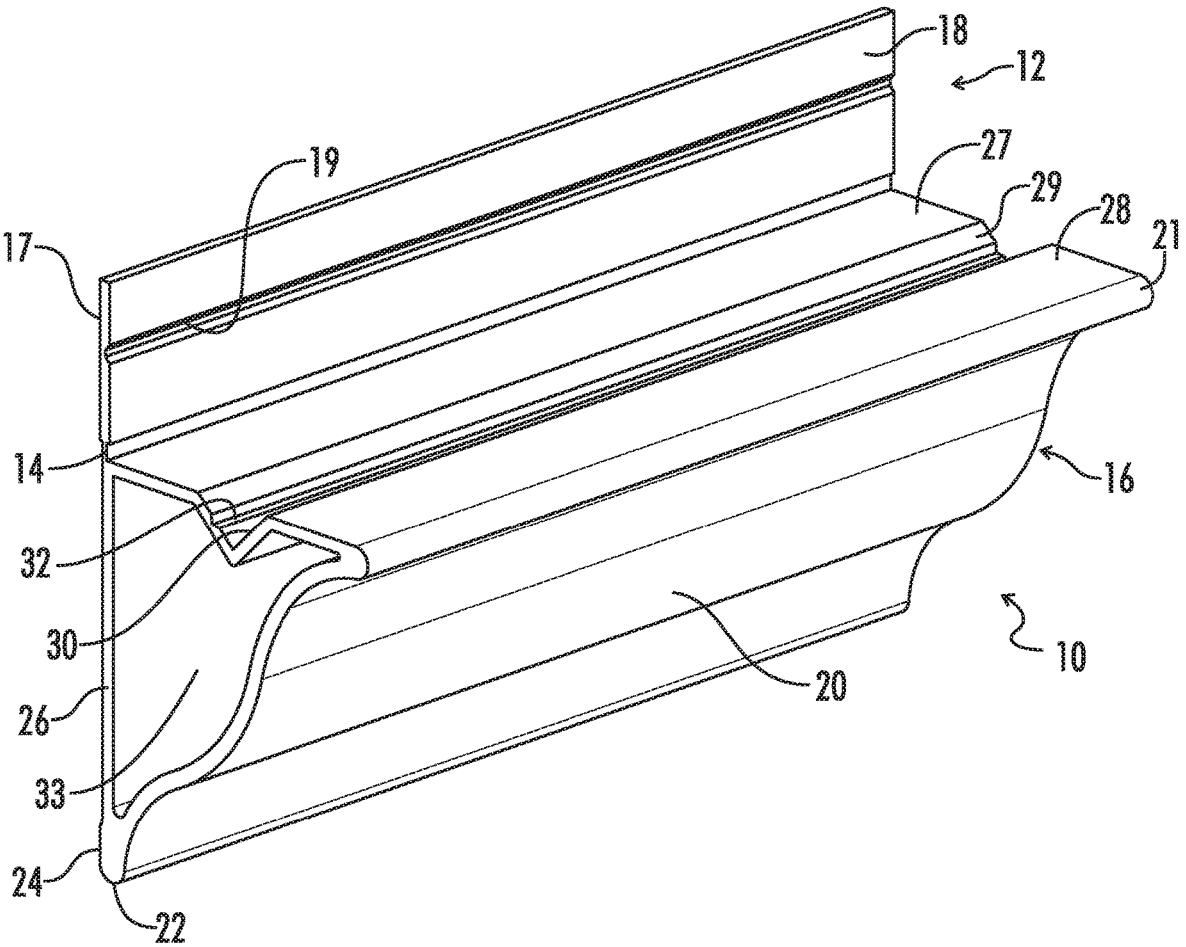
FIG. 1 is a perspective view from the front of a crown molding section in accordance with the present invention.
Figure 2:
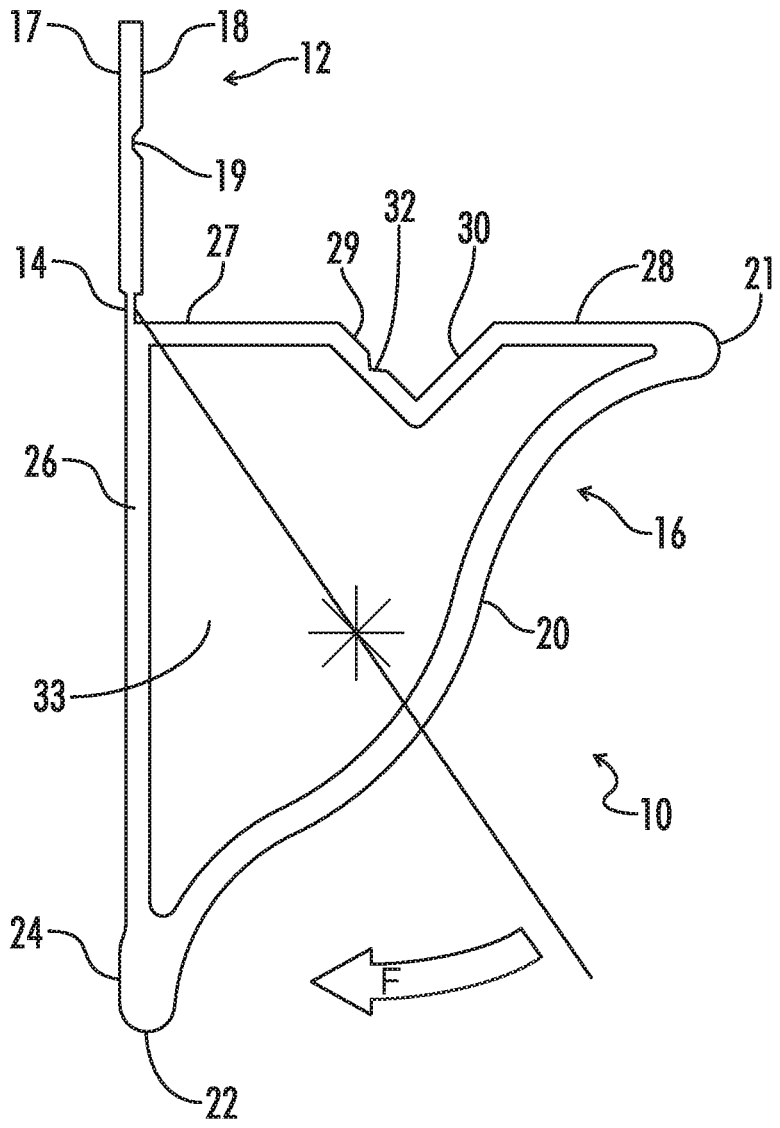
FIG. 2 is a side diagrammatic view of the crown molding section shown in FIG. 1.
Figure 3:
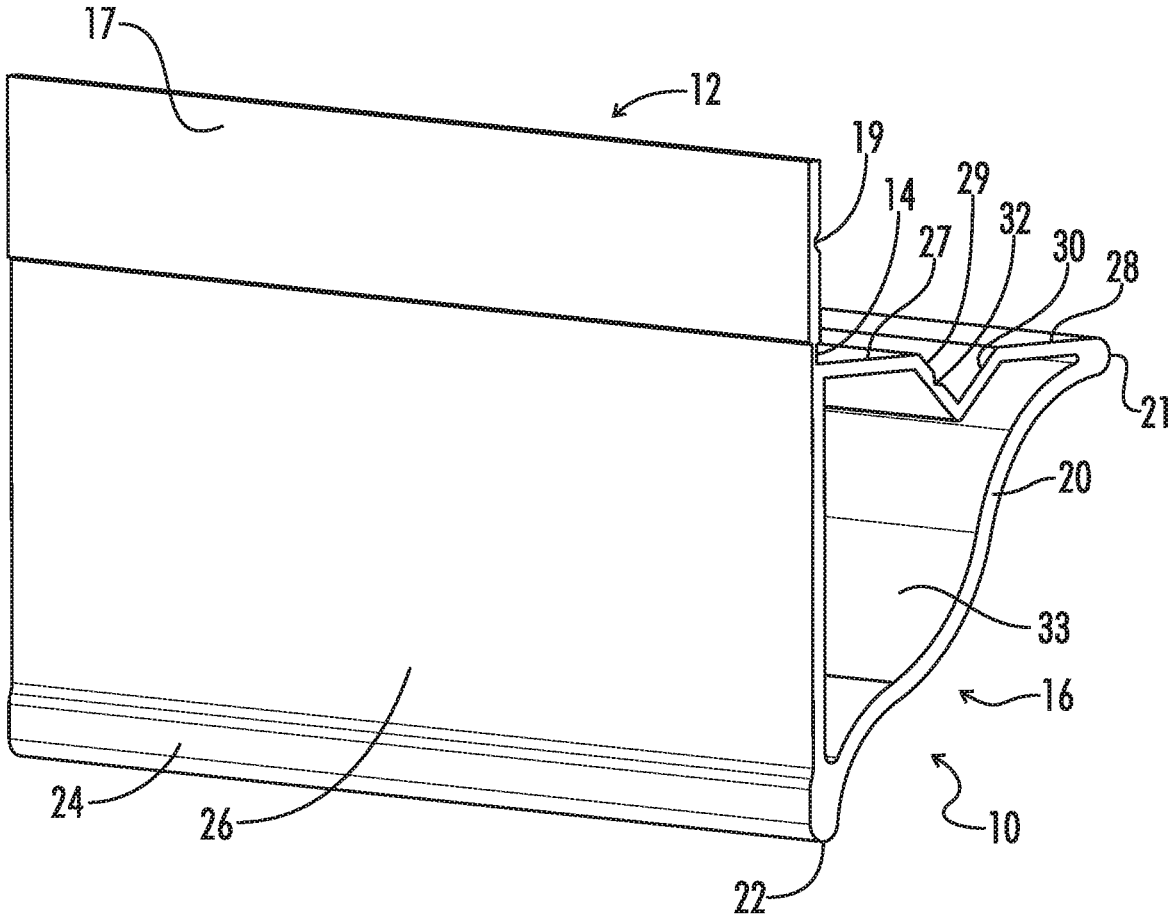

FIGS. 1-15 illustrate several embodiments and features of a crown molding system and assembly in accordance with the present invention. Referring now in particular to FIGS. 1-3, a straight crown molding section 10 forming part of the crown molding system and assembly is shown. Crown molding section 10 includes an attachment portion 12 which as described below serves as the primary means for securing the molding section 10 to a support surface such as a building interior wall surface, a hinge 14 extending along an edge of attachment portion 12, and a decorative molding portion 16 secured to hinge 14. Attachment portion 12 has a wall contacting or wall attachment surface 17, and an opposite facing surface 18 in which a fastener location groove 19 is provided extending longitudinally for positioning and driving a piercing type fastener such as a screw or other attachment member through the attachment portion 12 into the wall or a stud supporting the wall in order to secure the molding section 10 to the wall. Groove 19 is the location for the primary fastener used to attach the molding system of the present invention to a wall. Alternatively, in place of a piercing fastener, a suitably strong adhesive may be applied to the rear attachment surface 17 of attachment portion 12. If required, an additional fastener may be applied through attachment portion 12 either above or below groove 19 along the same vertical line to increase the adhesion strength of the molding section 10 to a wall framing member.

Hinge 14 extends preferably continuously between the attachment portion 12 and the molding portion 16. Molding portion 16 includes a decorative face 20 having an upper end 21 and a lower end 22, a lower wall contacting surface 24, a back member 26 extending between lower attachment surface 24 and hinge 14, an inner horizontal member 27 connecting at a right angle to back member 26, an outer horizontal member 28 extending from the upper end 21 of decorative face 20, and a pair of oppositely inwardly angled members 29 and 30 which form a "V" shaped member connecting between inner and outer horizontal members 27 and 28. A screw or other fastener location groove 32 is provided in angled member 29 which is used in a manner to be described to secure sections of the molding 10 as well as other components of the molding system together in an end-to-end relationship and reducing the likelihood of any gaps in the decorative face 20 where the sections of molding 10 meet. In addition, the "V" shape formed by inwardly angled members 29 and 30 provides for the interconnection screw location such that a screw or other fastener does not violate the horizontal plane formed by the surfaces of inner and outer horizontal members 27 and 28 for any ceiling components when installed or supported by the molding assembly. Finally, an opening 33 extends longitudinally in the body molding or portion 16 between decorative face 20, back member 26, horizontal members 27 and 28, and angled members 29 and 30, which together form preferentially stiff molding portion 16.

Attachment portion 12 is preferably constructed to flex in any direction as needed to follow the contour of, and be secured to, an irregular wall surface. As such, attachment portion 12 is flexible in a three-dimensional sense or in each of the x, y, and z axes. As best shown in FIG. 2, attachment surface 17 of attachment portion 12 and lower wall attachment or contact surface 24 of decorative body section 16 are both facing rearwardly and in one embodiment are substantially aligned in the same vertical plane. Contact surface 24 may have a generally flattened surface as shown in FIG. 2, while in other embodiments as will be shown may be rounded or differently shaped so as to have different wall contacting surface areas. The lower edge 22 of the decorative face 20 is shown in FIG. 2 as having a rounded shape or radius which provides a shadow that will obscure imperfections in the wall surface against a straight molding section. It will be understood, however, that lower edge 22 may been differently shaped in order to provide alternative desired decorative patterns and appearances.

In addition, hinge 14 and back member 26 are spaced or offset towards the decorative face 20 from the attachment surface 17 and lower attachment surface 24. As a result, when attachment portion 12 is secured to a wall having a substantially geometrically perfect planar wall surface, in which the plane is perfectly straight and plumb, and both attachment surface 17 and lower attachment surface 24 are in contact with the wall surface, the rearwardly facing surfaces of hinge 14 and back member 26 will not contact the wall surface. Instead, there will be gap or space formed which allows for variations in the wall surface such that lower attachment surface 24 can be pivoted into contact with the wall surface where otherwise the rearwardly facing surfaces of hinge 14 and back member 26 might impede or interfere with such contact. Back member 26 may also flex as needed, and may include one or more openings, as in an open extrusion, as long as the structure is maintained through all installation and normal use activities.

Hinge 14 operates in a manner similar to a piano hinge situated between attachment portion 12 and molding portion 16 in that hinge 14 serves as a flex point which allows the molding portion 16 and decorative face 20 of the molding section 10 to pivot or fall into the wall surface at its desired location. In FIGS. 1-3, hinge 14 is shown as a narrowing of the material of the molding section extrusion, where the material itself, using existing materials and engineering practices, is provided with a flexibility necessary to allow force F, shown by the arrow in FIG. 2, to act to urge lower wall contacting surface 24 of molding portion 16 against the vertical wall surface, even when attachment surface 17 of the attachment portion 12 is tightly drawn or held to the wall by one or more fasteners passed through the attachment portion 12 into the wall, or by an adhesive with multiple adhesion points within surface 17. An adhesive may also be applied to substantially the entire area of attachment surface 17 such that attachment surface 17 and the entire attachment portion 12 of the molding section 10 is immobile, yet hinge 14 allows for a pivot action of the decorative body portion 16 since the hinge 14 allows for independent pivoting movement of the body portion 16 to ensure that the lower wall contacting surface 24 contacts the wall.

Where the molding section 10 is mounted on a geometrically perfect plane of a wall by attachment portion 12, the lower wall contacting surface 24 would also be in contact with the wall surface with no flex required at hinge 14. However, the present invention allows for the molding assembly to be tightly and securely attached to a wall surface at attachment surface 17, and any irregularities in the wall are absorbed by the ability of the attachment portion 12 of the molding system to flex with the wall, while the molding portion 16 of the molding assembly moves preferentially less, and lower wall contacting surface 24 always maintains contact with the wall. Additionally, body portion 16 is constructed such that the decorative face 20 presents a desirable straight appearance to the room even if the molding assembly is mounted on an irregular wall. It is noted that the designed placement of the decorative face (spring angle, etc. in regular crown molding) is maintained as well as its straightness.

In the embodiment shown in FIGS. 1-3, both horizontal members 27 and 28 are also preferentially thick. This allows the molding assembly to also act as the perimeter member of a suspended ceiling grid system. As such, it is preferable that the horizontal surfaces of members 27 and 28 remain flat within the horizontal plane of the ceiling, so that grid members and ceiling tiles that rest on the molding system are flat and neat in appearance. It is further noted that any hardware outside of the molding system and attachment hardware that rests on horizontal members 27 and 28 or is otherwise attached to any portion of the molding assembly below hinge 14, will add to the force F shown in FIG. 2 and serve to reinforce the desired placement of lower contact surface 24 against the wall.

The molding assembly of the present invention may be constructed of a composite material including fiber reinforced polymers (FRP) in order to retain the flexibility of hinge 14 while maintaining the needed strength against sheering at such point. Existing engineering practices may apply FRP methods to allow flexibility at hinge 14 while maintaining necessary strength. Existing methods and practices may also be leveraged to harden or use materials having different levels of flexibility, such that the decorative face 20 may be formed of a stiffer material than the material forming at least hinge 14. Differential stiffness can ensure that the decorative face of the molding section along its distance from the wall to the top of the decorative face remains stiff and in its desired placement. The molding assembly may be manufactured using FRP using a process such as pultrusion. FRPs made using pultrusion can be designed, using standard methods and practices related to pultrusion and FRPs, to provide the desired strength and flexibility characteristics of the molding assembly. In particular, FRP can be used to allow flex at the hinge while also preventing shear at the hinge. Another FRP practice could be used to create a cavity immediately behind the decorative face of the molding body, running nearly the length of the decorative face from top to the bottom, which cavity is filled, post pultrusion, with a foam that, after filling the cavity, becomes rigid. Such a standard practice has long been used to strengthen tool handles and the like. Pultrusion combined with a rigid foam core immediately behind the decorative face would be ideal in certain embodiments in which the decorative face would be preferentially stiff even though the surrounded pultruded material would allow the desired flex for secure attachment to an irregular wall. A rigid foam core could also be applied to a standard extrusion with the same result.

Figure 10:
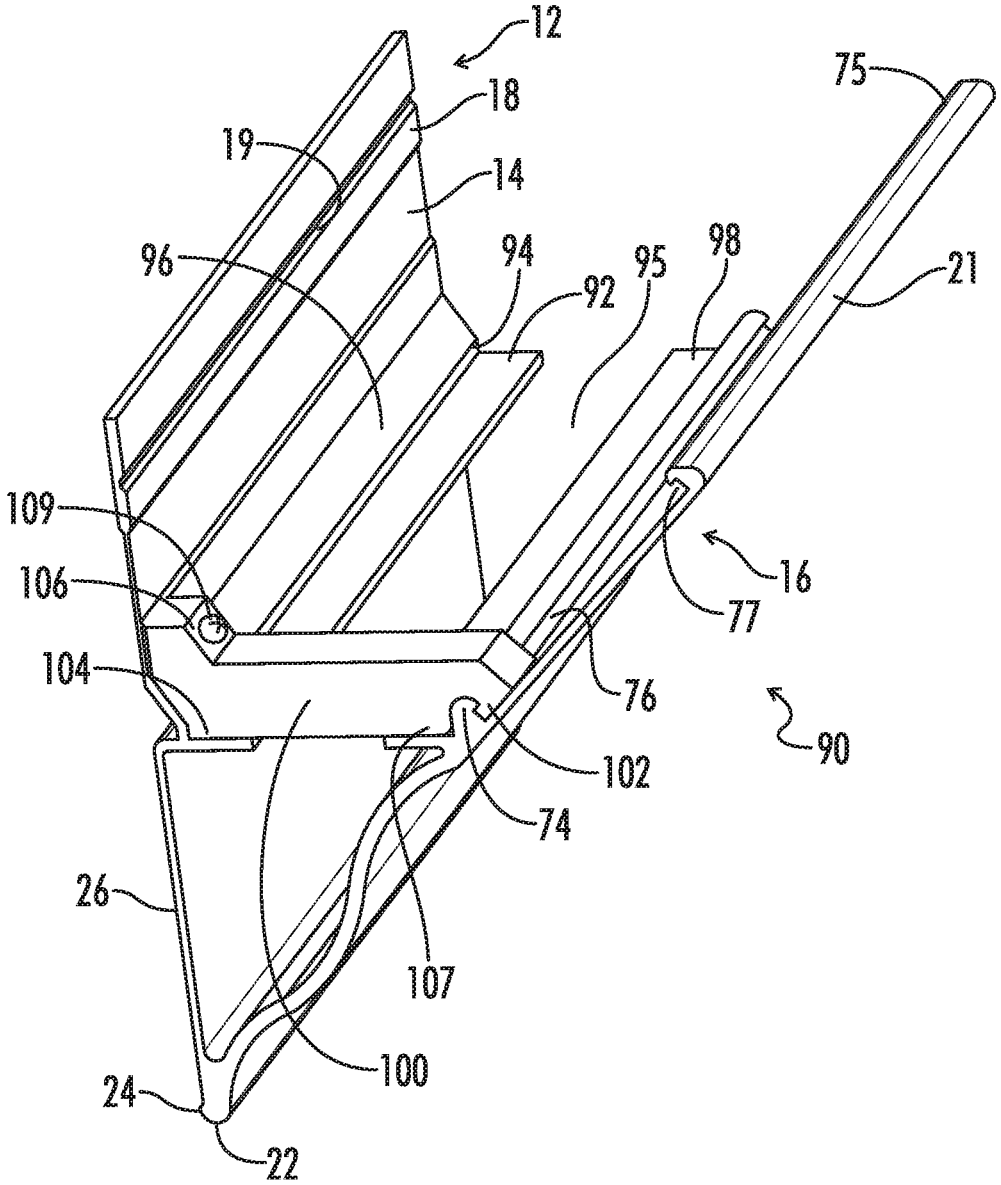
FIG. 10 is a perspective top side view of another embodiment of the crown molding assembly of the present invention.
Figure 11:
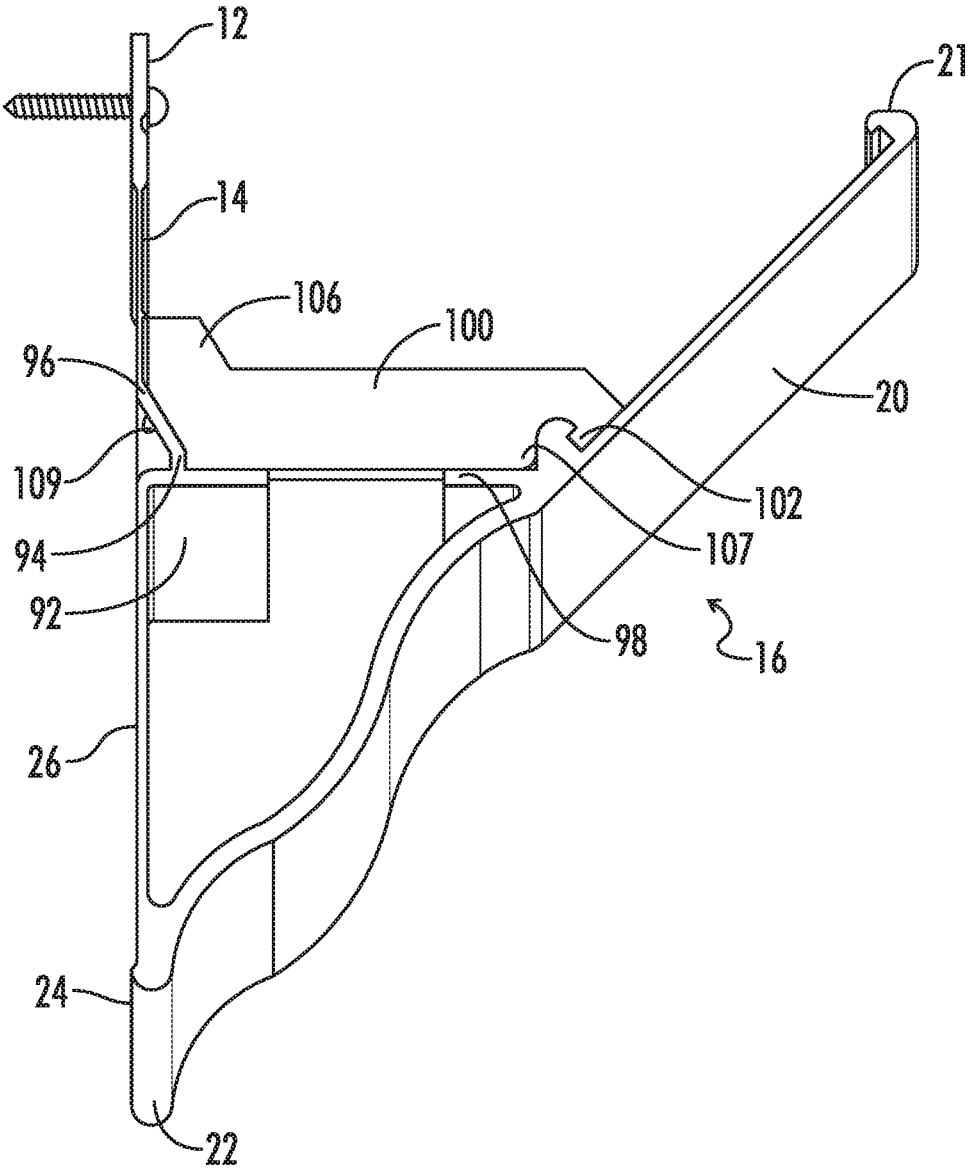
FIG. 11 is perspective bottom side view of the molding section shown in FIG. 10.
Figure 12:
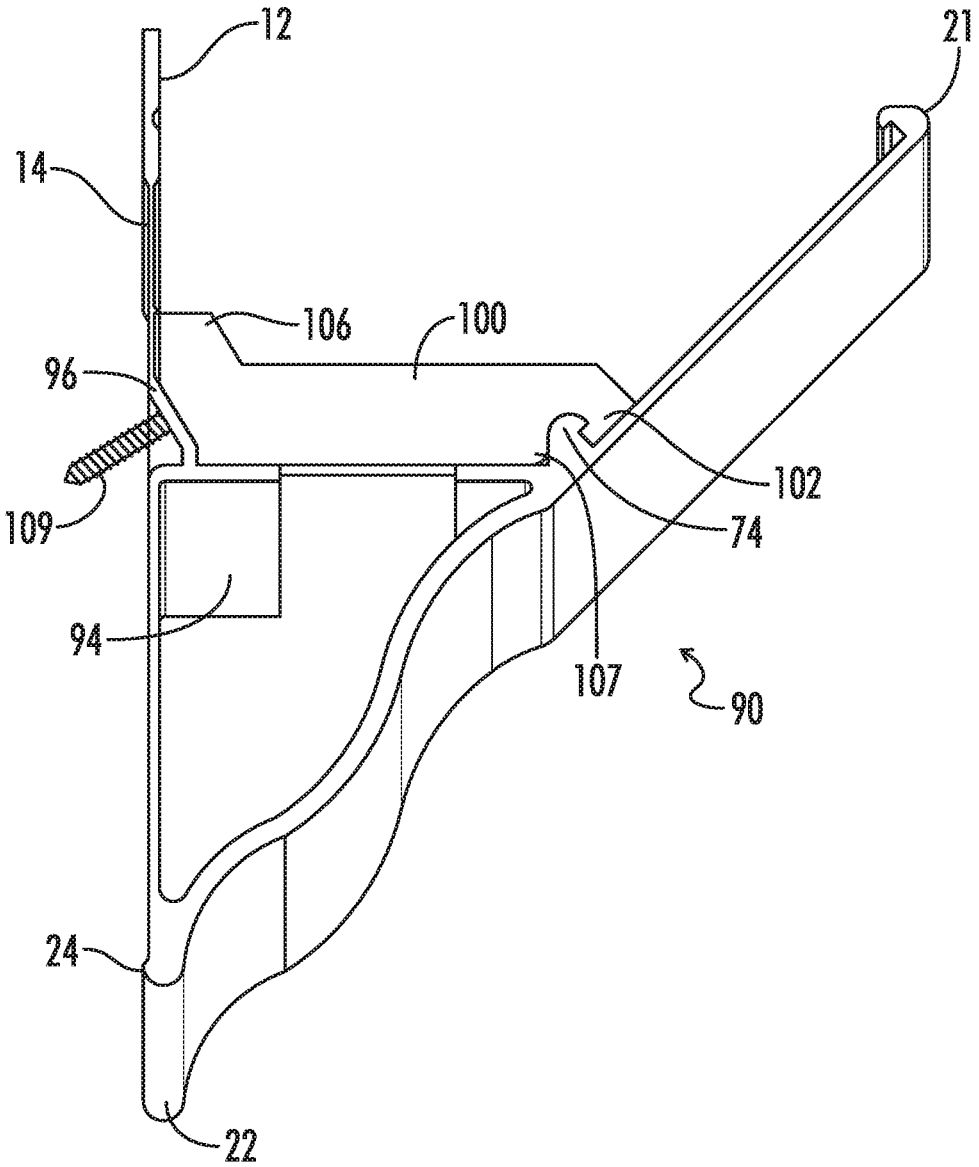
FIG. 12 is similar to FIG. 11 illustrating a different fastener means.

In addition, as a result of hinge 14 enabling a pivot which forces the lower wall contacting surface 24 against the wall even when attachment portion 12 is securely attached to the wall and immobile, conditions which cause movement of the wall could enable the hinge 14 and allow unwanted movement of the molding system restricted to lower wall contacting surface 24 pivoting away from the wall. This might occur during an earthquake, when movement of the wall itself could cause the molding assembly to pivot away from the wall. This might also occur if the molding assembly is mounted on a large watercraft such as a cruise or cargo ship, where heavy seas could change the wall angle such that the simple pendulum force changes significantly enough to cause contact area 24 to move away from the wall. This movement could be prevented by applying an adhesive to the lower wall contacting surface 24. Alternately, some embodiments of the molding assembly, at least one of which is illustrated in FIGS. 10-12, may allow for a screw to be driven through the vertical molding assembly surface from above and behind the decorative face, but below the hinge, where that screw is not for installation or structural support in a stable room, but to prevent lower contact surface 24 from separating from the vertical surface to which it is mounted in a situation of a moving room. Any adhesive or screw or nail fasteners applied to the lower contact portion would not be considered to play a structural role in installing the molding, but rather being limited to preventing unwanted movement under conditions of a moving wall.

Hinge 14 may also provide a structural break from the attachment portion and attached wall with respect to acoustics, and particularly transmission of impact noise and mechanical vibrations from the wall to which the molding system is attached, and from ceiling grid members to the attached wall. This is an improvement over standard metal perimeter moldings, which are rigid and rigidly attached to the wall. Most construction standards require at least some suspended ceiling grid members to be securely attached to the perimeter molding, especially in areas of high seismic risk. Existing practices, materials and methods have been implemented in suspended ceiling tiles, and they can substantially attenuate noise, particularly airborne noise. However, when reducing impact noise and mechanical vibration, it is typically desirable to provide a structural break to prevent direct sound transmission from one building element to another. Suspended ceiling grid members frequently contact, if not support, mechanical systems such as HVAC components. The present invention provides an incomplete, but substantially improved, structural break between a ceiling grid and the walls to which it is attached by attaching grid members to the crown molding system at horizontal members 27 and 28.

Figure 4:
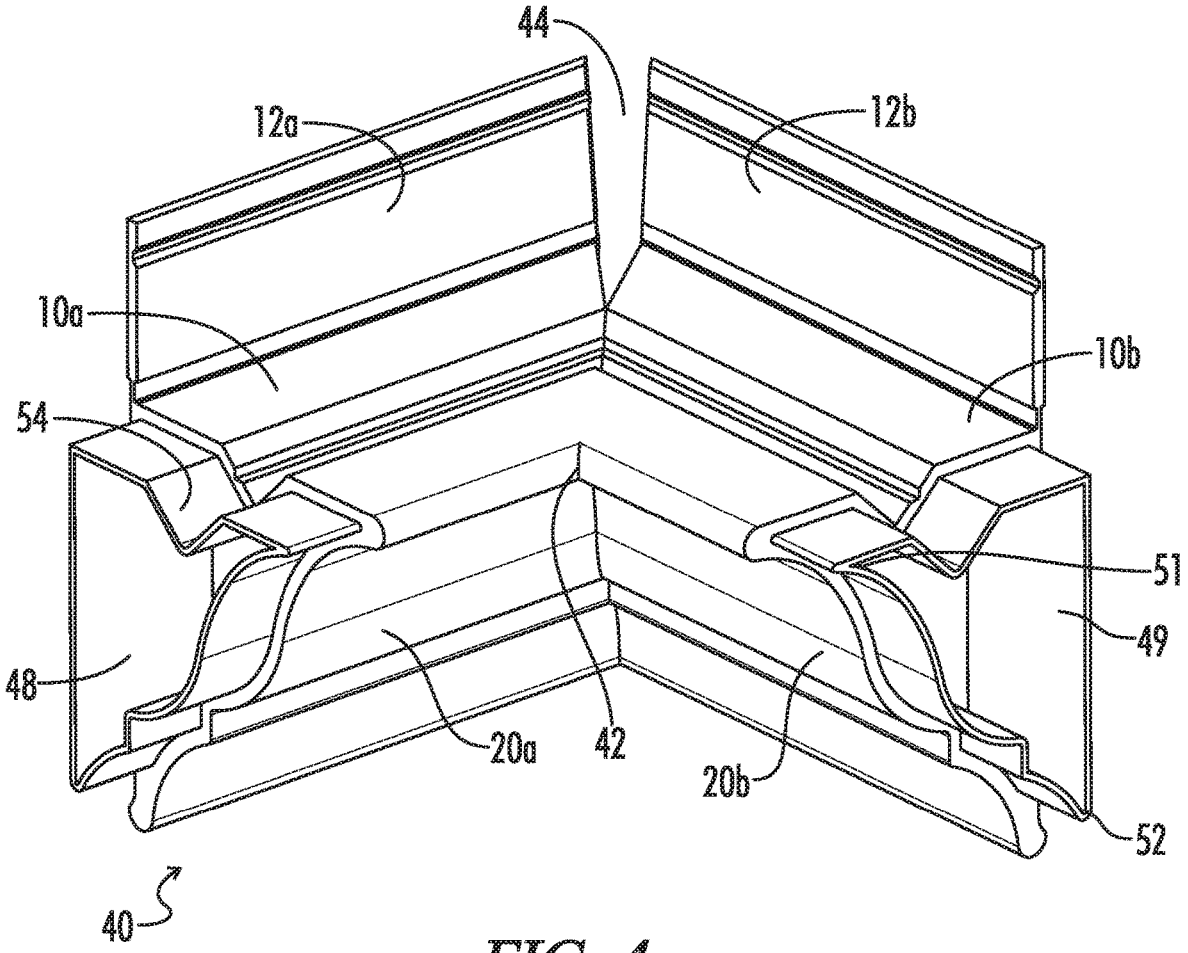
FIG. 4 is a perspective front view of an inside corner section of the crown molding assembly.
Figure 5:
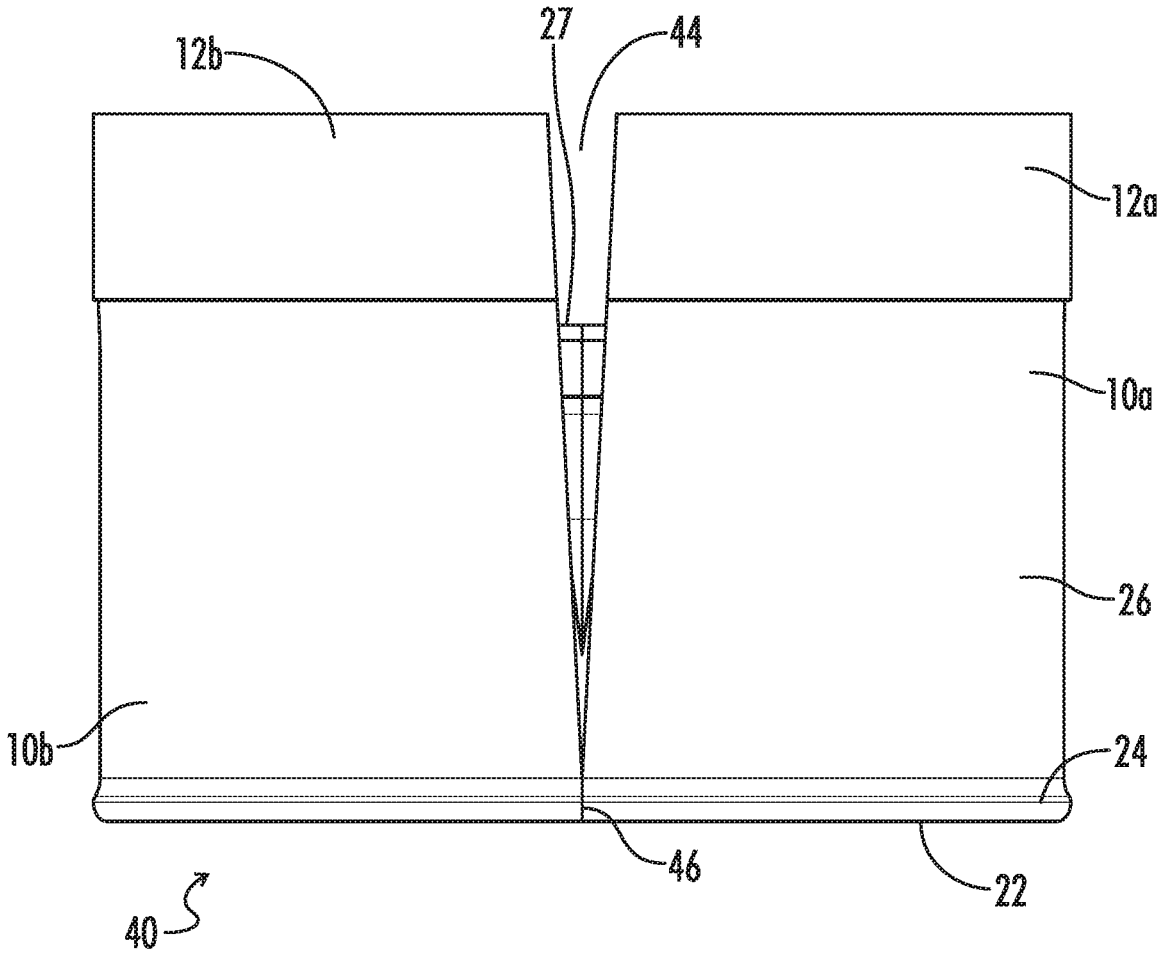
FIG. 5 is a perspective rear view of the inside corner section shown in FIG. 4.

As illustrated in FIGS. 4-7, the molding assembly of the present invention also includes pre-made inside and outside corner members 40 and 60, respectively. Referring now in particular to FIGS. 4-5, an inside corner assembly 40 is shown which includes two short crown molding sections 10*a* and 10*b* having a structure which is similar to that described above with respect to FIGS. 1-3. Molding sections 10*a* and 10*b* are joined such that the decorative faces 20*a* and 20*b* intersect and are substantially at a right angle with respect to each other, forming an inside corner. The intersecting decorative faces 20*a* and 20*b* of inside corner member 40 are joined along their full length at intersection 42 from the top to bottom edge of the decorative faces. However, a gap 44 is provided at the inside corner between attachment portions 12*a* and 12*b*. Gap 44 will typically extend at least partially between the back members 26 and horizontal members 27, as shown in FIG. 5. Gap 44 is provided to allow for the molding corner assembly 40 to be positioned in a finished inside wall corner such that lower wall contact surface intersection 46 of molding sections 10*a* and 10*b*, shown in FIG. 5, can be adjustably positioned on a wall so that the molding assembly has a best finished appearance. Gap 44 thus allows the attachment portions 12*a* and 12*b* to be securely attached at the particular location they contact the wall surface, and in the manner previously described with respect to a straight molding section 10, may flex to an imperfect wall corner without disrupting the placement of wall contact surface intersection 46. As a result, the decorative face intersection 42 and bottom edge intersection 46 result in the appearance of a perfectly constructed crown molding intersection regardless of any imperfection in the walls and wall corner to which the molding is attached.

Also illustrated in FIGS. 4-5 are a pair of alignment insert members 48 and 49 which are designed to be positioned in the open ends 33 of aligned corner and straight sections of the molding assembly in order to secure the adjacent sections together. Inserts 48 and 49 preferably have the same shape as the interior shape of open ends 33 but with slightly lesser dimensions so that the inserts can slidingly fit in the open ends 33 of the molding sections and providing a tight fit between the sections. In particular, the upper and bottom edges 51 and 52 of the alignment inserts 48 and 49 must be dimensioned to fit precisely in the molding sections to ensure a proper alignment of decorative face 20, when two separate molding assembly pieces intersect. In an embodiment, the alignment inserts 48 and 49 may be provided as separate pieces which are secured in the ends of both aligned assembly pieces, or in another embodiment may be integrally formed as part of the inside corner member 40.

In connecting sections of the molding assembly using the alignment insert, the V-shaped surface 54 of the alignment inserts will be pierced by a fastener which is also passed through the screw location groove 32 in inwardly angled member 29 of the molding sections. The alignment inserts will force the alignment of the decorative faces 20 of connected pieces of the crown molding assembly, to align with the decorative faces 20*a* or 20*b* of the inside corner assembly 40. A stand-alone alignment insert may be used to join two straight molding sections 10 together without any built in alignment inserts. In other possible components of the molding assembly, the molding sections may also include a gap to allow for a transition to a standard metal perimeter molding, or where it is desired to have a finished appearance similar to where regular crown molding would be terminated along a straight wall the molding assembly may include a built in termination of a straight section of this crown molding assembly.

In certain embodiments, it may be advantageous to extend gap 44 along the back member so that the lower contact surfaces 24 do not actually meet each other. This can be advantageous to allow for known artifacts of drywall finishing at a corner, such as a corner bead which is often sticking out a small amount. As long as the bottom edges 22 of the molding sections meet at intersection 46 shown in FIG. 5, the decorative face intersection 42 will appear uninterrupted to the room, since in the presently described embodiment the molding section has a rounded bottom edge such that the part of the molding assembly behind the bottom edge 22 is by design obscured by shadow and therefore not necessary for the inside corner section to have a finished appearance.

Figure 6:
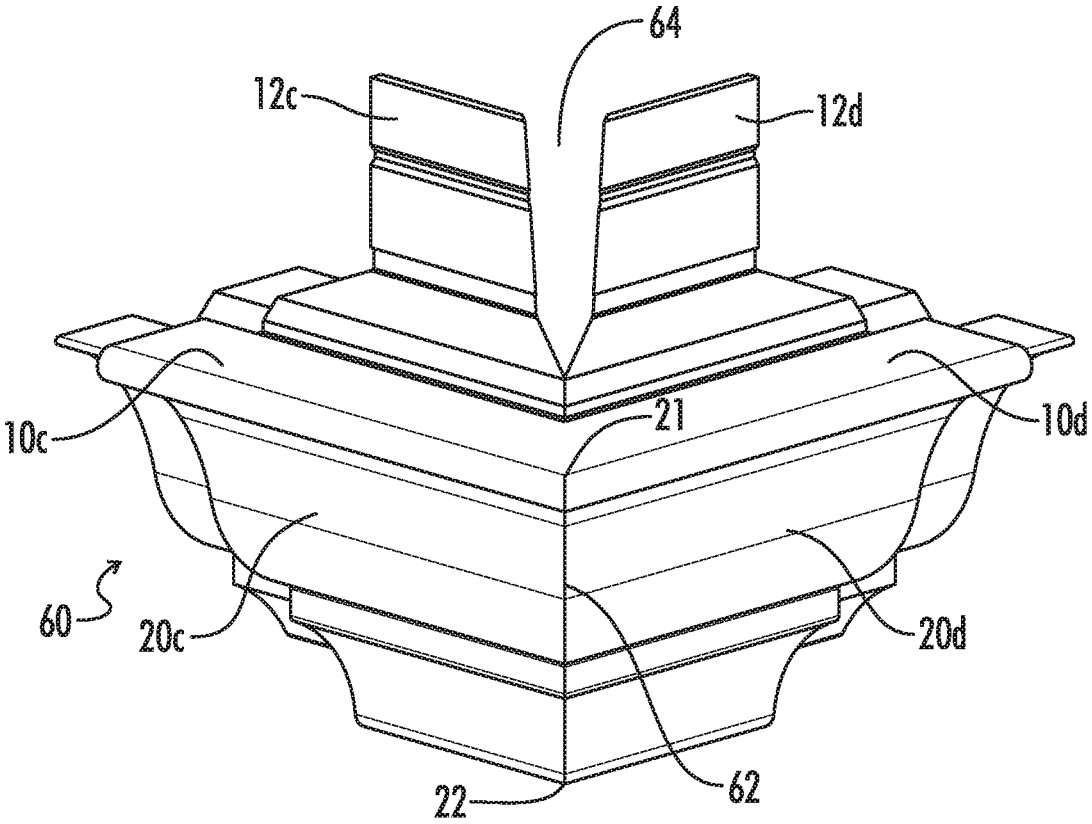
FIG. 6 is a perspective front view of an outside corner section of the crown molding assembly.
Figure 7:
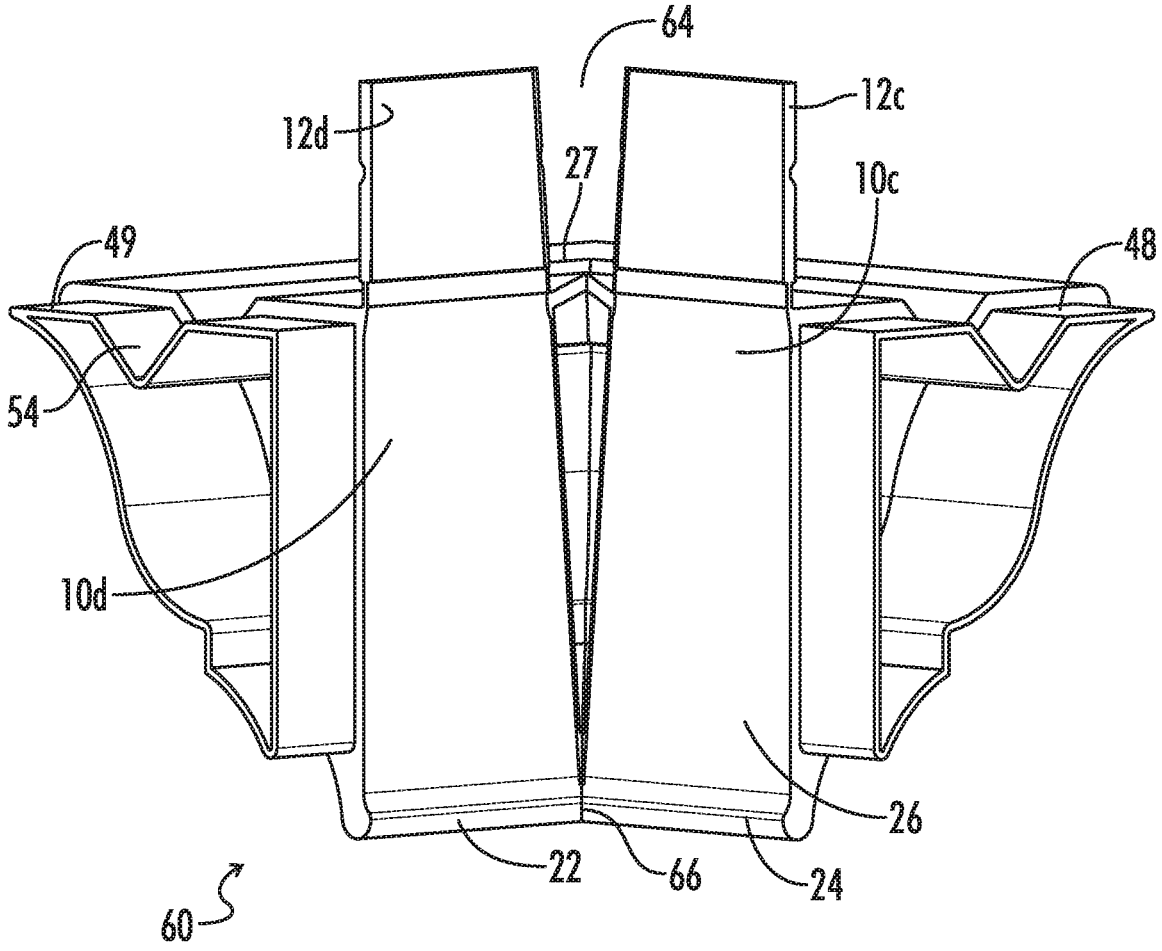
FIG. 7 is a perspective rear view of the outside corner section shown in FIG. 6.

FIGS. 6 and 7 illustrate an outside corner assembly 60, which similar to inside corner assembly 40 includes two short crown molding sections 10*c* and 10*d* having a structure which is similar to molding section 10 described above with respect to FIGS. 1-3. Molding sections 10*c* and 10*d* of outside corner assembly 60 are joined such that the decorative faces 20*c* and 20*d* intersect and are substantially at a right angle with respect to each other, forming an outside corner. The intersecting decorative faces 20*c* and 20*d* of outside corner member 60 are joined along their full length at intersection 62 from the top to bottom edge of the decorative faces. However, a gap 64 is provided at the outside corner between attachment sections 12*c* and 12*d* of outside corner assembly 60. Gap 64 will typically extend at least partially between the back members 26 and horizontal members 27, as shown in FIG. 7. Gap 64 allows the molding corner assembly 60 to be positioned in a finished outside wall corner such that lower wall contact surface intersection 66 of molding sections 10*c* and 10*d*, shown in FIG. 7, can be adjustably positioned on a wall so that the molding assembly has a best finished appearance. Gap 64 thus allows the attachment portions 12*c* and 12*d* to be securely attached at the particular location they contact the wall surface, and in the manner previously described with respect to a straight molding section 10 may flex to an imperfect wall corner without disrupting the placement of wall contact surface intersection 66. As a result, the decorative face intersection 62 and bottom edge intersection 66 result in the appearance of a perfectly constructed crown molding intersection regardless of any imperfection in the walls and wall corner to which the molding is attached.

Alignment insert members 48 and 49 are also provided with outside corner assembly 60 and as with inside corner assembly 40 may either be integrally formed as part of the outside corner assembly or may be provided as separate pieces which are secured in the ends of both aligned assembly pieces. In connecting other crown molding sections of the molding assembly to the outside corner assembly using the alignment inserts 48 and 49, the V-shaped surface 54 of the alignment inserts will be pierced by a fastener which is also passed through the screw location groove 32 in inwardly angled member 29 of the molding sections. The alignment inserts will force the alignment of the decorative faces 20 of connected pieces of the crown molding assembly, to align with the decorative faces 20*c* or 20*d* of the outside corner assembly 60. In certain embodiments, it may be advantageous to extend gap 64, shown in FIG. 7, along the back member 26 so that the lower contact surfaces 24 do not actually meet each other, which as discussed above with respect to the inner corner assembly 40 can be advantageous to allow for known artifacts of drywall finishing at a corner, such as a corner bead which is often sticking out a small amount. As long as the bottom edges 22 of the molding sections meet at intersection 66 shown in FIG. 7, the decorative face intersection 62 of the outside molding assembly 60 will appear uninterrupted to the room, since in the presently described embodiment the molding section is shown having a rounded bottom edge such that the part of the molding assembly behind the bottom edge 22 is by design obscured by shadow and therefore not necessary for the inside corner section to have a finished appearance. However, in other embodiments in which the molding assembly does not have a rounded bottom edge, the same general principles for aligning the inner and outer corner molding assemblies will apply.

It will be understood therefore that the pre-made inside and outside corners of the present inventors' crown molding assembly can be made using the same principles of the present invention, namely that the attachment portion of the molding system pre-made corner can flex to match an irregular corner while the decorative face of the pre-made corner remains preferably in position. Further benefit is in maintaining a perfect intersection between the two sections of molding that meet in said corner, even better than a cope cut or a miter cut. Corner pieces of this type can be pre-made for any number of corner angles, most commonly 90 degrees as illustrated.

Figure 8:
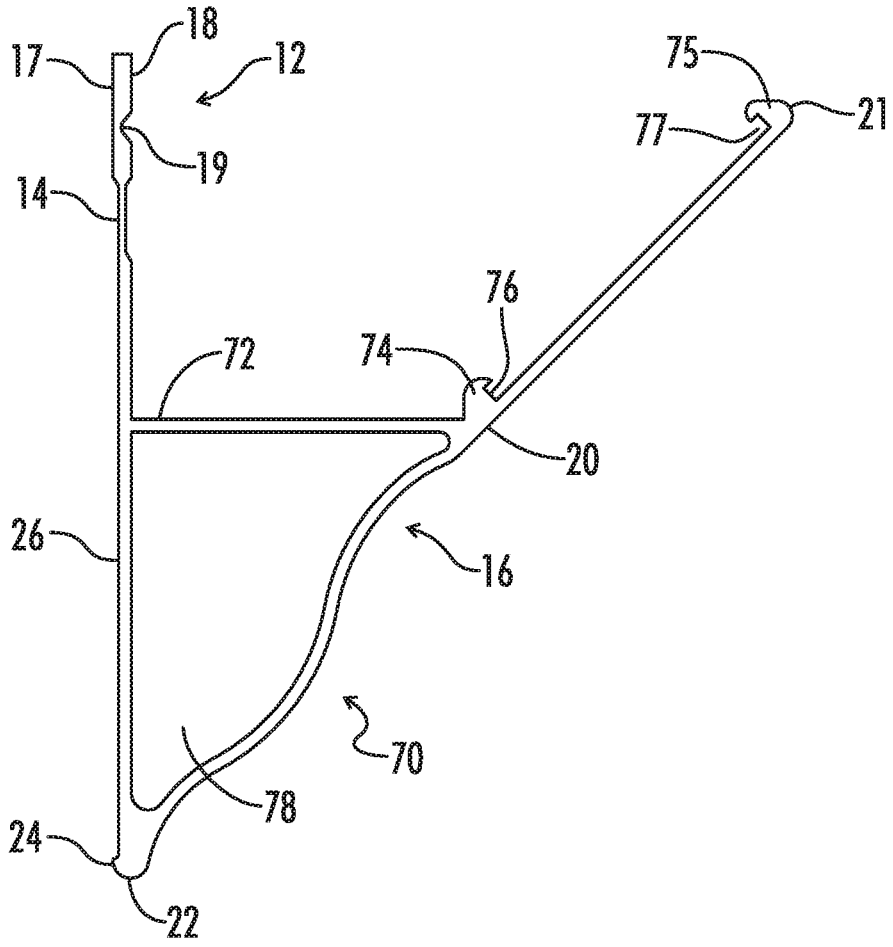
FIG. 8 is a side diagrammatic view of another embodiment of the crown molding assembly of the present invention.
Figure 9:
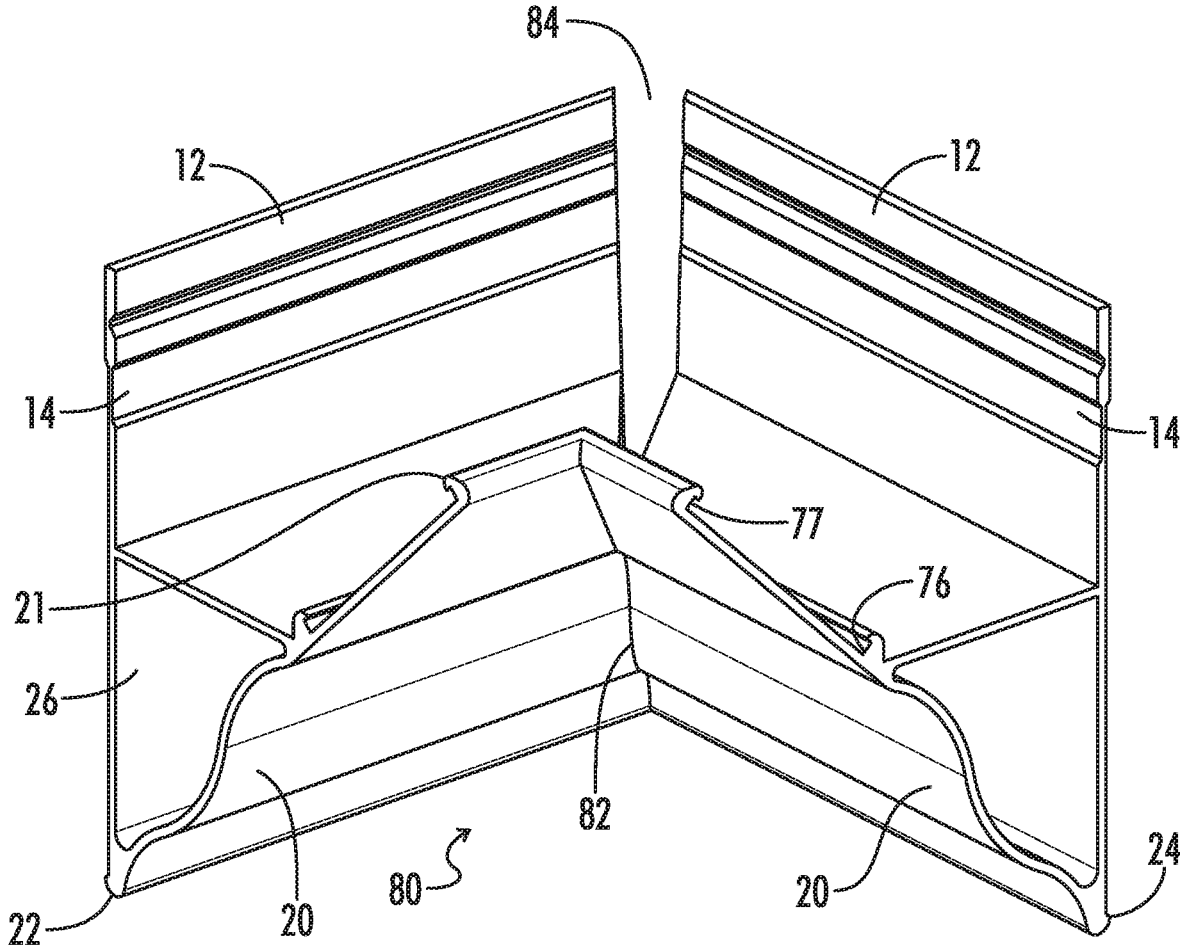
FIG. 9 is a perspective front view of an inside corner section for use with the crown molding section shown in FIG. 8.

FIGS. 8-9 illustrate another embodiment of the crown molding assembly of the present invention. Molding section 70, similar to molding section 10 described above with reference to FIGS. 1-3, includes an attachment section or flange 12 for securing the molding section 70 to a support surface such as a building interior wall surface, a hinge section 14 connected on one end to attachment section 12, and a decorative body section 16 secured to hinge section 14. Attachment section or flange 12 has a wall contacting or wall attachment surface 17, and an opposite facing surface 18 in which a fastener location groove 19 is provided extending longitudinally for positioning and driving a piercing type fastener such as a screw or other attachment member through the attachment section 12 into the wall or a stud supporting the wall in order to secure the molding section 70 to the wall. Groove 19 is the location for the primary fastener used to attach the molding system of the present invention to a wall. Alternatively, in place of a piercing fastener, a suitably strong adhesive may be applied to the rear attachment surface 17 of attachment section 12. If required, an additional fastener may be applied through attachment flange 12 either above or below groove 19 along the same vertical line to increase the adhesion strength of the molding section 70 to a wall framing member.

In molding section 70, hinge section 14 is shown as being longer than in molding section 10 shown in FIG. 2, but still serves as a flex point and extends preferably continuously between the attachment section 12 and the body section 16. Molding body section 16 includes a decorative face 20 having an upper edge 21 and a lower edge 22, a lower wall contacting surface 24, a back member 26 extending between lower attachment surface 24 and hinge member 14, and a horizontal member 72 connecting at a right angle to back member 26 and to the rear surface of the decorative face 20. Horizontal structural member 72 is positioned below the upper edge 21 of the decorative face 20, unlike horizontal members 27 and 28 in FIG. 2.

In addition, a pair of spaced apart tabs 74 and 75 are provided on the inner surface of the decorative face 20 above the location of horizontal member 72. Tabs 74 and 75 form upper and lower notches 76 and 77, respectively, which notches open towards each other such as to provide a slot for placement of an alignment insert, not shown. More particularly, the alignment insert will be sized to extend between and fit in the notches 76 and 77 along the rear surface of decorative face 20, and ensures that the middle portions of decorative face 20 are properly aligned when adjacent molding sections are installed and secured together in an end-to-end relationship.

An internal cavity 78 is formed extending longitudinally in the molding section 70 in the space bordered by the lower surface of horizontal member 72, the rear surface of the decorative face 20 below horizontal member 72, and the inner surface of back member 26. Such internal space is protected by the structure of the molding. Another difference between molding section 70 and the previously described molding section 10 is in molding section 70, the screw location groove 19, and resulting screw location, is below the uppermost edge 21 of the decorative face 20 of the molding portion. This may be desirable to ensure that the screw cannot be seen, and it is noted here that the screw location 19, and also the attachment portion 12, may extend as low as desired relative to the decorative face 20, as long as the pivot that enables the hinge-like flex is above the center of mass of the molding portion 16. The location of the pivot above the center of mass of the molding portion 16 (the pendulum in this simple pendulum model) enables the desired force urging the lower edge 22 of the molding into the wall.

The hinge portion 14 includes a flex point which as in the previously described embodiment is designed to allow the attachment flange 12 to be drawn tightly to an irregular wall, and for the attachment flange 12 to flex to meet those irregularities and provide a secure attachment for one or more fasteners through attachment flange 12 and into the wall onto which the crown molding system is attached, presumably into a stud or other framing member to facilitate secure attachment. The hinge portion prevents those irregularities from transmitting from the attachment flange 12 to any other components of the molding assembly below the hinge portion 14. As such, the hinge portion 14 may flex in any direction necessary to facilitate the flex needed as a result of secure attachment of the attachment flange to an irregular wall. In addition, the flex point acts as a pivot point for the improved molding assembly to pivot into the wall, most importantly, at lower wall contact surface 24. By separating the attachment point and flex point, the molding assembly can be securely attached by any method that is useful, including adhesive, or multiple attachments in profile (multiple screws, one directly above the other), and since flex point provides the pivot, the molding will still behave as a simple pendulum with lower wall contact surface 24 being urged into the wall to which the molding system is attached. The hinge portion 14 and resulting flex action can be created by using thinner material at hinge portion 14, or using a different material, or a different curing process that imparts greater flexibility to hinge portion 14, or any other method in the art to enable the described flex at hinge portion 14. As indicated above, fiber reinforced polymer (FRP), either by pultrusion for straight sections, or molded for premade corners, may be used, or any more suited methods known in the art. FRP, both pultruded and molded, can also use fiber content, type, orientation and other parameters to affect different mechanical properties, including within one pultruded profile. Thus, one pultruded profile could exhibit increased flexibility in one portion of the profile and decreased flexibility in another portion of the profile, using methods known in the art of FRP and pultrusion.

In addition, lower edge 22 of decorative face 20 has a curved profile. More particularly, the decorative face 20 curves down and towards the absolute bottom of the molding portion 16, which curve continues around to lower wall contact surface or point 24. In cross section, the bottom of the molding section 70 is defined by a semicircle, or bottom half of a circle, with lower edge 22 and lower wall contact surface 24 located on the semicircle which blends in smoothly into the rest of the decorative face travelling up to the top edge 21 of the decorative face. The semicircle is provided because it creates a shadow between the bottom of the molding and the wall. When in a room with this molding system 70 installed, the semicircle, will be readily visible under normal lighting conditions, and the molding area between lower edge 22 and contact surface 24 will be obscured by shadow, and difficult to see. Also, the molding assembly will cast shadow on the wall, specifically the area where lower wall contact surface 24 contacts the wall and slightly below that, likely to the point horizontal to lower edge 22. This is very useful because all walls have some manner of imperfection, and deviate from a perfect geometric plane. Since, by design, the decorative face 20 remains preferentially straight when installed on an imperfect wall, there will be gaps along the wall wherever those imperfections are as lower contact surface 24 remains preferentially straight. The present design employs the shadow behind the back quarter of the bottom semicircle (from lower edge 22 to lower contact surface 24) to obscure these gaps. Further, since the molding may grab the eye as a decorative element, the crisp straight lines of the preferentially stiff decorative face may cause the viewer to see the straightness of the molding and extrapolate that straightness to the wall, even when there are fluctuations in the wall. This is especially true when the area where the straight molding meets the wall, which otherwise would make gaps visible and apparent, is hidden in shadow and not visible to the room occupant.

In order to manufacture the crown molding of the invention, the material must be flexible at least at flex point or hinge portion 14 and attachment flange 12 must also be flexible. However, in keeping with the overall invention, the decorative face must remain preferentially straight, maintaining the desired form of the molding even when attached to an irregular wall. Because the decorative face 20 is not supported with structure in the present embodiment above horizontal structural member 72, the material and/or processes used to form molding section 72 must be strong enough to ensure the desired placement of decorative face as well as all other components of the molding system that are dependent upon decorative face 20 for support. Pultrusion is a preferred manufacturing method, since very complex profiles can be made with more than the strength required to maintain decorative face 20 in a desired position without direct support of a structural member. Further, the flex point 14 can be designed using a specific fiber structure that imparts flexibility, yet maintains shear strength in the vertical direction. A different cure, in addition to different fiber designs, may be used for either flex point 14 or the entire attachment flange 12 such that there may not be a shape defining flex point 14, but the different cure process would result in increased flexibility of either or both attachment flange 12 as a whole, and/or flex point 14.

FIG. 9 is a front view of an inner corner section 80 for use with the molding section 70 shown in FIG. 8. As in the previous embodiment the decorative faces 20 intersect at a point 82 and are connected along the entire decorative face from top edge 21 to bottom edge 22. In addition a gap 84 is provided between the attachment flanges 12 and hinge portion 14, which gap also extends at least partway into horizontal structural member 72 and back member 26. The gap, which it will be understood is utilized at both inside and outside corners, allows for the assembly to be pushed into (or onto) a finished wall corner such that lower wall contact surface intersection 24 can be placed for best finished appearance, and the attachment flanges 12 can be securely attached wherever they land and can flex to an imperfect wall corner without disrupting placement of the intersection of the lower wall contact surfaces such that decorative face intersection and bottom edge intersection result in the appearance of a perfectly constructed crown molding intersection regardless of imperfection in the walls and wall corner to which the molding is attached. As with the previous embodiment, it may be advantageous to extend the gap 84 down so low that lower contact surfaces 24 do not actually meet each other. This can be advantageous to allow for known artifacts of drywall finishing at a corner, such as a corner bead which is often sticking out a small amount. As long as the bottom edges 22 of the molding meet, the decorative face intersection will appear uninterrupted to the room since the part of the molding assembly behind the intersection of the bottom edges is obscured by shadow (by design) and not necessary for a finished appearance. To connect a straight section 70 to corner section 80, an insert (not shown) is utilized as described above in slots 76 and 77 to align the decorative faces of the side by side pieces. In addition, an insert similar to inserts 48 and 49 discussed above with respect to the previously described embodiment may be inserted in internal cavity 78 in the molding body sections 20 situated below horizontal structural member 72. A piercing type fastener may then be passed through structural member 72 and the insert to secure the molding sections together. It will also be understood that while the embodiments of the invention are being described as including premade corners, both inside and outside corners, for rooms containing 90 degree corners, different corner angles such as 45 degree and 30 degree angles, any other useful corner angle, may be utilized.

It will be evident therefore that the molding section 70 can be interconnected using a process similar to the interconnection of the previously described embodiment, wherein the focus is on aligning the decorative face of each section using alignment pieces that are not visible to the room. In the embodiment shown in FIGS. 1-3, as described above a single internal sleeve style piece is sufficient for aligning interconnecting pieces. However, in the present embodiment, since internal cavity 78 does not travel the entire height of decorative face 20 from upper edge 21 to lower edge 22, additional pieces and securing methods are necessary. A piece of a finite length, such as two inches, would be sufficient to align two internal cavities 78, assuming a sleeve or insert shaped to fit the interior contours of internal cavity 78 is utilized. This sleeve could be fixed in place by a screw through both structural member 72 and the alignment sleeve, where one screw through both for each molding section being joined would lock not just the alignment sleeve in place, but would lock the two molding sections next to each other. Further uses of this embodiment may call for electric wires or other equipment to be installed within internal cavity 78. In this case, penetrating screws may disrupt the wires, puncturing insulation and causing an unsafe condition. Therefore, an adhesive may be used to secure the internal alignment sleeve such that it straddles the intersection of both molding sections where they meet. Also, once the adhesive sets, the alignment sleeve will also serve to maintain the two molding sections both aligned and closely next to each other. In the case where the continuous internal cavity 78 between multiple molding sections must be waterproof to function as a watertight passageway, either the adhesive itself, or a sealing adhesive may be used and applied completely around the internal alignment sleeve such that a watertight seal is achieved.

One method for installing the alignment sleeve in the presently described embodiment calls for one or more holes to be drilled through structural member 72 in both molding sections which are to be abutted. These holes should be within about one-half the length of the alignment insert away from the ends of the molding sections which are to be abutted, and should be wide enough that the alignment insert could be moved within internal cavity 78 in the direction of the molding by tapping a flat screwdriver or similar tool through the holes drilled in structural member 72. After installing one of the molding sections to be abutted, the alignment sleeve is inserted completely inside internal cavity 78. If needed, sealant or adhesive can be applied to both internal cavities 78 such that when complete, the joint of the two abutting molding sections with an internal alignment sleeve spanning the joint is water tight. When the alignment insert is fully within internal cavity 78, the second molding section is placed. Then the alignment insert can be advanced within internal cavity 78 of the installed molding section towards the abutting molding section and advanced inside the second molding section. As long as this process is completed before the drying, setting or curing time of the adhesive or sealant is past, the result should be a physically aligned internal cavity, where the presences of the internal alignment sleeve is visible on both sides of the joint (through the holes that were drilled) and is watertight.

In addition to an alignment sleeve, other pieces are needed to ensure and secure alignment of decorative face 20 from top to bottom along a system of multiple sections of molding of this embodiment. As indicated above, therefore two notches 76 and 77 are provided for the insertion of an alignment tab. The purpose of the alignment tab is to ensure alignment of the middle of the decorative face 20 is maintained when two adjacent molding sections abut. An alignment tab may be a simple piece of plastic or other suitable material whose length is on the order of about two inches (or whatever length is necessary to secure alignment of decorative face 20) and wide enough to fit against the back of decorative face 20 between notches 76 and 77. The alignment tab must also have a thickness that allows for the tab to function as needed, and fit into the alignment notches 76 and 77. The method for using the alignment tab involves mounting the first molding section on the wall. The alignment tab can then be inserted into the mounted molding until at least all of the alignment tab has slid into notches 76 and 77 along the length of the molding far enough that no part of the alignment tab extends beyond the end of the molding section. The second molding section can then be placed in position immediately next to the mounted piece (the goal to provide the appearance of a continuance decorative face 20 when there are really two molding sections abutting). The alignment tab can then be slid towards the second molding section until about half of the length of the alignment tab is in each molding section. This can be accomplished by pushing the alignment tab into the notches of the new molding section, or can be tapped using appropriate tools, such as a hammer and a flat screwdriver or punch. The second molding section can now be permanently attached to the wall. In other embodiments, an alignment pin can be used to align the uppermost portions of decorative face when two molding sections are aligned, in which case slots for receiving the pins may be provided on the rear surface of the decorative face. The pins would have a length sufficient to align the uppermost portion of decorative face when spanning the abutting joint of two molding sections. Similar to the alignment tab, the pin can be placed fully inside the slot or placement location for the first mounted molding section, and then tapped into position spanning the joint and inside both slots or placement locations and securing a continuous appearing decorative face around the joint. A combination of alignment methods including those described above may also be utilized.

To reiterate, the core concept of the present invention is maintaining a preferentially straight decorative face even as the attachment flange is securely attached to an imperfect wall, which concept is extended to a premade corner. The intersection of decorative faces remain preferentially oriented and placed with the lower molding edge appearing perfectly defined (due to use of shadow) and the decorative faces from top to bottom edges, and from the start of the premade corner (where it would abut a separate molding section), on each side, would proceed in a preferentially straight manner to the decorative face intersection. This preferential orientation, alignment and intersection of the decorative faces occurs into what appears as a perfectly formed crown molding joint, even as the corner to which the premade corner is mounted is imperfect, and both attachment flanges, each drawn tightly to the imperfect corner, flex as needed. In addition, a gap as described above is present for either an inside or outside corner which would at the least allow for the attachment flanges to flex independently of each other when securely attached to the imperfect corner of the wall. The attachment flanges would extend into the corner far enough that a fastener driven through the attachment flange would be ensured to penetrate a framing member in all (or very nearly all) cases. In most construction this would mean extending the attachment flanges deep enough into the corner that a penetrating fastener would hit a stud. The two flanges would never meet at the corner, the resulting gap enabling independent flex.

In another embodiment, at the top of the molding, a location for lighting may be provided, while in another embodiment there is a structure designed to perform as a standard ⅞×⅞ inch metal suspended ceiling perimeter would. This embodiment would need to draw considerable strength from its material, and would likely benefit from an FRP or other composite. This embodiment would contain no lighting location, and in most typical installations would have a suspended ceiling and grid system installed to the structure and throughout the room. By creating a suspended ceiling perimeter structure, and designing into the FRP the necessary properties and strength within a shape and thickness that allows the structure to be installed with standard ceiling hardware that is designed to be used with a standard metal perimeter, ceiling installers can use all of the same materials, clips, grid members and installation methods for attaching a suspended ceiling to a standard metal perimeter to install a suspended ceiling to the structure, resulting in a finished crown molding appearance while using all existing ceiling hardware. An additional advantage would be the ability to use existing seismic clips and hardware, which, if new seismic clips and hardware were required, would need to undergo extensive and expensive testing to be certified. Similar to the above embodiment, the concepts applied to the straight section of this embodiment could be applied to premade corners, inside and outside, of any useful angle.

FIGS. 10-13 illustrate another embodiment of the crown molding assembly of the present invention. In FIGS. 10-12 a straight crown molding section 90 is shown, which differs from the embodiment shown in FIG. 8 in that the horizontal cross member 72 of the molding portion in FIG. 8 has been modified and does not extend from the decorative face 20 of the molding continuously to the rear member 26 of the molding portion. Instead, as shown in FIG. 10, the horizontal cross member is interrupted in profile creating a gap 95 between inner horizontal member 92 and outer horizontal member 98 which, in cross section, extends for the entire length of the molding section. Such a gap 95 may be useful to provide access from above to the lower compartment situated below members 92-98, such as for insertion of electrical wiring in the compartment or other useful purposes.

Since the horizontal cross member is no longer continuous from the decorative face 20 to the rear 26 of the molding portion 16 of the molding system, the cross member no longer provides structural support for maintaining the preferred position of the decorative face 20 of the molding relative to the attachment portion 12 and the wall. FIGS. 10-12 also illustrate that, in the case that structural reinforcement similar to what would be provided by a continuous horizontal cross member is required, this can be added periodically as needed to maintain the desired position of the decorative face of the molding system under normal use by the provision of removable cross member 100. The cross member 100 is supplemental and acts as reinforcement. It is possible to design the molding as illustrated in FIGS. 10-12 with a very strong material, or designed with a materially thicker material, that would structurally maintain the position of the decorative face 20 of the molding system without additional reinforcement, especially in the case where the molding system is not used to support additional equipment or a non-structural ceiling, and is placed high enough in the room that it is out of reach of occupants of the room and, as such, would not be handled. However, it may also be desired to design the structure of the molding portion of the molding system such that the desired strength is achieved with the additional, secondary structure 100 shown.

The present invention does not depend upon the nature of the molding portion structure, whether it be a unitary structure that is consistent across its profile, or whether one or more structures are added as reinforcement to the molding portion of the system, so long as the decorative face is maintained in its desired position and the installation portion is still able to flex independently to absorb wall imperfections. Any additional reinforcing structure is located behind the decorative face, and any attachment methods or fasteners for securing one or more secondary reinforcing members will not disturb the decorative face.

Referring still to FIGS. 10-12, note that the rear portion of the molding portion 16 immediately above the interrupted inner cross member 92 has an angled portion 96 that angles away from the rear of the molding portion 16 before proceeding with leg 94 to the top of the rear portion of the interrupted cross member 92 vertically. This angled portion is placed so that an installer can drive a fastener 106 through this angled surface 96 after the molding system is installed on a wall, provided there is either a removable ceiling (such as a suspended ceiling) or sufficient space above the molding and below a rigid permanent ceiling. Additional reinforcing structural member 100 has a finger section 102 which is secured into the lower alignment insert slot 76 on the rear surface of the decorative face, which finger section 102 fits so that it grabs and holds the decorative face 20 in place from within slot 76. The rear portion 104 of the additional reinforcing structural member 100 includes an angled portion 106 which rests on top of the interrupted horizontal member 92 and also rests on the angled surface 96 that meets the rear of the molding portion, while the front portion 107 rests on outer cross member 98. This arrangement allows the additional reinforcing structural member 100 to be secured using a single fastener passed through the additional reinforcing structural member 100 and through the angled portion 96 of the molding system. As pictured in FIGS. 10 and 11, the fastener 109, such as a screw, need only be long enough to penetrate both the horizontal structural member 100 and the angled portion 96 of the rear of the molding portion, and can thereby secure the additional reinforcing structural member 100 without extending past the rear of the molding system or contacting the wall.

However, there may be conditions under which it may be desired to reinforce the desired placement of the lower contact portion 24 of the molding portion 16 against the wall, even though the simple pendulum action will continually urge that placement. For example, the invention enables a hinge like flex that allows the lower contact surface 24 to fall like a pendulum and contact the wall regardless of wall imperfections at the attachment portion 12 that would otherwise force the lower edge of a rigid molding system out from the wall. If the room is stable, and the molding system is not disturbed after it is installed, the hinge like flex serves well. However, if an earthquake were to substantially shake the walls to which the molding system is installed, that hinge-like flex may enable the molding system to sway and shake possibly cause damage as the room moves. To prevent such movement, and to ensure that the desired position of the lower portion of the molding system contacts the wall as desired, an additional fastener such as a screw 109 may be driven through the angled surface 96 within the molding portion 16 as shown in FIG. 12, and driven into the wall. The fastener 109 must be located below the pivot, and can serve as a supplemental reinforcement of the placement of the lower edge 24 of the molding system against the wall, and to prevent the movement of the molding system in an earthquake.

Figure 13:
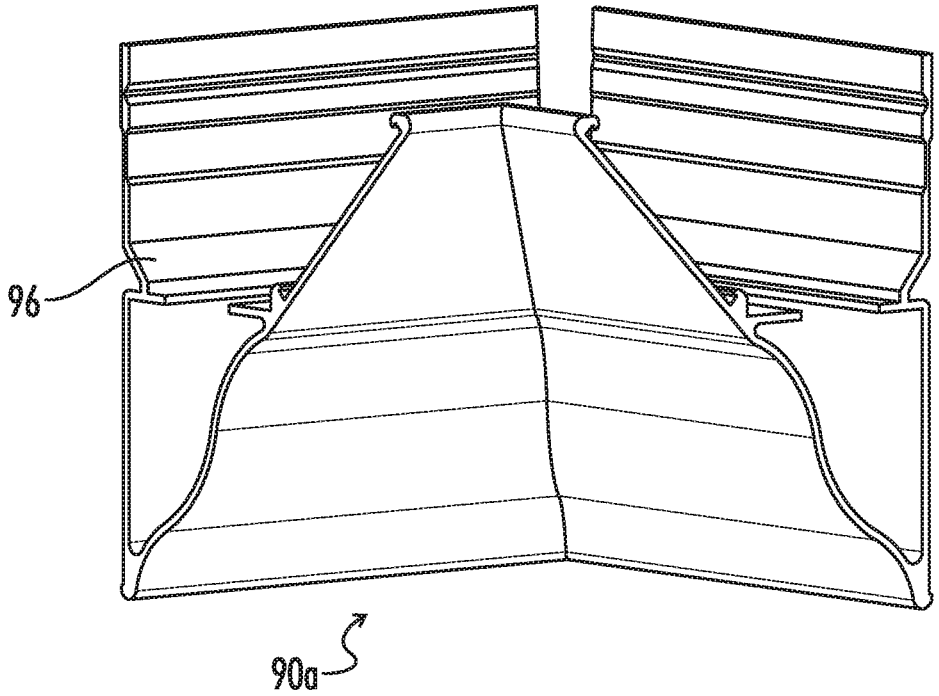
FIG. 13 is a perspective front view of an inside corner section for use with the crown molding section shown in FIGS. 10-12.

FIG. 13 illustrates an inner corner section 90*a* for use with the molding section 90. It will be understood that the inner corner section 90*a* may be connected abutting sections in a manner similar to that described herein with respect to the earlier described embodiments. In particular, however, it is noted that the detachable reinforcement sections 100 should be secured to the molding sections at a location which is spaced apart from the ends of the individual molding sections so as not to interfere with the connecting together of abutting sections. Thus, the notch 96 serves a dual purpose of supporting an alignment tab between abutting sections as well as being periodically used to secure the supplemental cross members 100 as needed.

Figure 14:
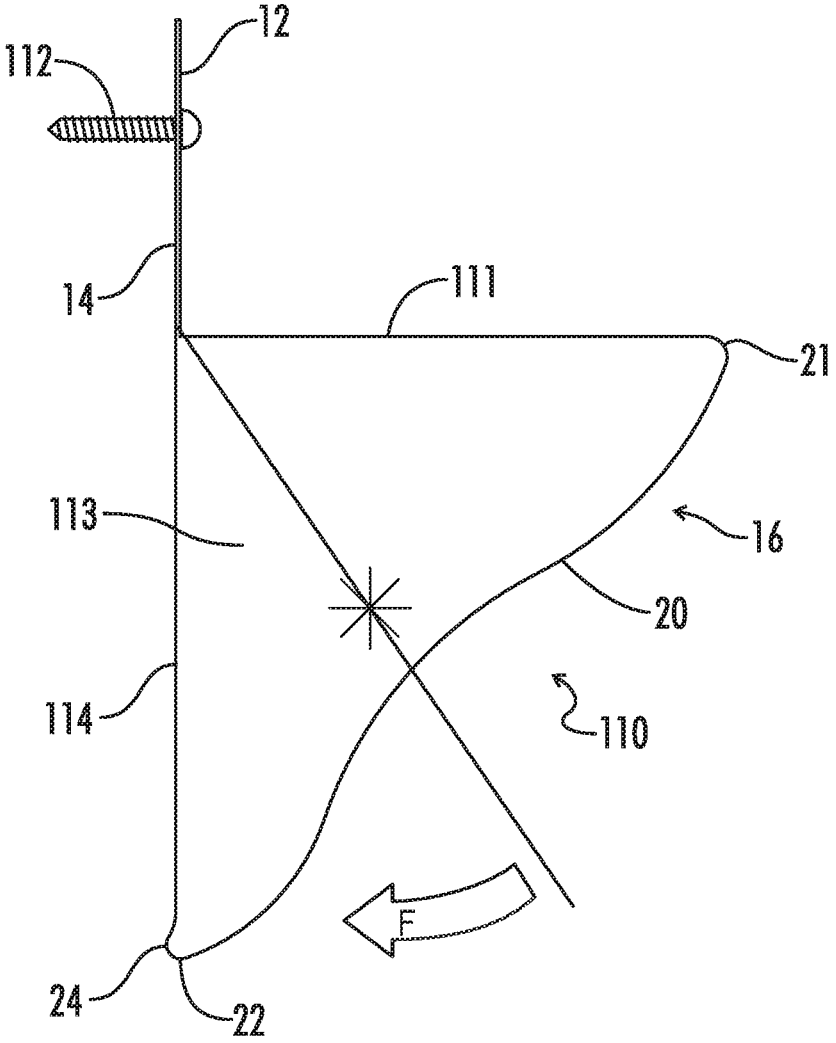
FIG. 14 is side diagrammatic view of another embodiment of the crown molding assembly of the present invention.
Figure 15:
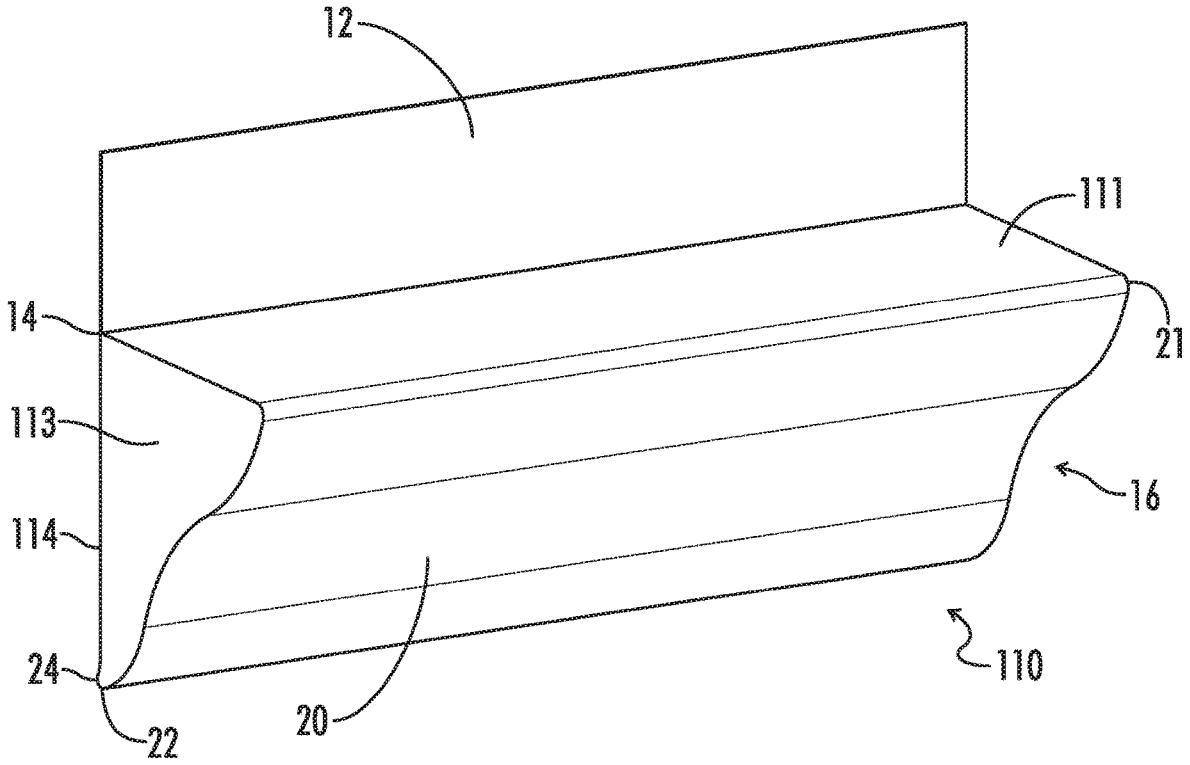
FIG. 15 is a perspective view of the molding section shown in FIG. 14.

FIGS. 14-15 illustrate another embodiment of the present invention, in which the crown molding section 110 has a solid molding section 16. Molding section 110 also has an attachment portion 12 which is made from a flexible material such as cloth. In this embodiment, the cloth is sufficiently strong, particularly against shearing and tearing, that a fastener such as screw 112 in FIG. 14 can be driven through attachment portion 12 and into the wall and can be securely tightened and thus support molding section 110. An example of such a cloth material of sufficient strength is that used for seatbelts, which has great strength and great flexibility. In this embodiment, the cloth material of attachment portion 12 extends inside of the solid interior portion 113, where it has been bonded, using existing technologies, into the solid material comprising molding portion 16. Such bonding can occur during an extrusion or molding process using existing practices. This co-extrusion or co-molding results in a unitary molding section 110.

Given the inherent flexibility of the cloth material comprising attachment portion 12, no specific design of the attachment portion is needed to enable hinge 14. The inherent flexibility of the cloth material will enable the pivot to molding portion 16's pendulum and enable force F of FIG. 14 to ensure placement of lower contact surface 24 against the wall. The inherent flexibility of the cloth material of attachment portion 12 also permits secure attachment to wall irregularities without transmitting those irregularities to molding portion 16.

Rear surface 114 of the molding portion 12, similar to other embodiments, curves in and away from the wall above lower contact surface 24 in order to clear any wall imperfections that protrude from the wall. Due to the solid structure of molding portion 16, upper surface 111 and decorative face 20, from lower end 22 to upper end 21, will each remain preferentially straight independent of any flex absorbed by attachment portion 12. With an upper surface that remains preferentially straight, molding section 110 would be well suited to acting as the perimeter of a suspended ceiling, supporting both ceiling frame members and tiles. It will be understood that materials other than cloth but having a similar flexibility and strength characteristics may be alternatively utilized as in the presently described embodiment.

In certain embodiments of the present invention, the crown molding the decorative face is thicker than the other components of the molding system, such as the vertical surface that meets the wall, the horizontal section that starts at the top of the decorative face, and the attachment flange. In such embodiments, when a fastener secures the attachment flange securely to a wall, or alternately an adhesive of sufficient strength may be used in place of a piercing fastener, the flange distorts to any irregularities, and those irregularities may or may not reflect or transmit to the vertical surface below the attachment area and the horizontal surface, but because of the additional material behind the decorative face, the decorative face will be less able to flex and, therefore, remain preferentially straight to the intended wall design.

In addition, as mentioned above, certain embodiments of the crown molding assembly of the present invention make use of a curve at the bottom of the molding assembly. The decorative face curves down towards the absolute bottom edge of the molding and curves through the bottom edge around to point wall contacting point as described above. For current purposes the curve is described as a circle whose radius pointing down and completely vertical is point the bottom edge, and the radius points into the wall horizontally forms the lower wall contact surface, while the radius pointing away from the wall and horizontal is near the bottom of the decorative face. An alternative description is that, in cross section, the bottom of the molding assembly is defined by a semicircle. That semicircle is the bottom half of a circle, and the bottom edge and lower contact points and the other end of the semicircle blends in smoothly into the rest of the decorative face travelling up to the top edge.

As discussed herein, the hinge or flex point between the attachment flange and decorative molding portions of the crown molding assembly is designed to facilitate two major features of the described implementation of the improved crown molding system. First, the flex point allows for the attachment flange to be drawn tightly to an irregular wall, and in addition to flex to meet those irregularities and provide a secure attachment for one or more fasteners through the attachment flange and into the wall onto which the crown molding system is attached, presumably into a stud or other framing member to facilitate secure attachment. The flex point prevents those irregularities from transmitting from the attachment flange to any other components of the molding assembly below the flex point. As such, the flex point may flex in any direction necessary to facilitate the flex needed as a result of secure attachment of the attachment flange to an irregular wall.

Second, the flex point acts as a pivot point for the improved molding assembly to pivot into the wall, most importantly, at lower wall contact surface. This comprises an improvement over the inventors' crown molding assembly described in U.S. Pat. No. 8,887,460. The earlier molding assembly pivots as a whole, and uses a single attachment point (in profile) as the pivot, with the entire molding assembly acting as a simple pendulum urging the molding assembly into the wall to which it is attached. This present invention, however, builds a pivot point into the molding assembly, below and separate from where the molding system is attached. As a result of separation of the attachment point and pivot point, the present molding assembly can be securely attached by any method that is useful, including adhesive, or multiple attachments in profile (including multiple screws, one directly above the other), and because the flexpoint provides the pivot, the molding will still behave as a simple pendulum with the lower molding contact surface being urged into the wall to which the molding system is attached.

As a result of these two actions of the flex point; one, allowing the attachment point to flex as it is drawn tightly to an irregular wall, while maintaining a preferentially undisturbed molding assembly and decorative face below; and two, the flex point acts as a pivot facilitating the pendulum action of the lower contact surface into the wall to which it is attached. Any additional hardware attached to the molding system below the flex point, such as suspended ceiling components, will reinforce the pendulum action and will reinforce the desired location of lower contact surface at the wall. The flex action can be created by using thinner material at the hinge or flex point, or using a different material, or a different curing process that imparts greater flexibility to the material forming the hinge or flex point, or other methods in the art to enable the described flex.

Figure 16:
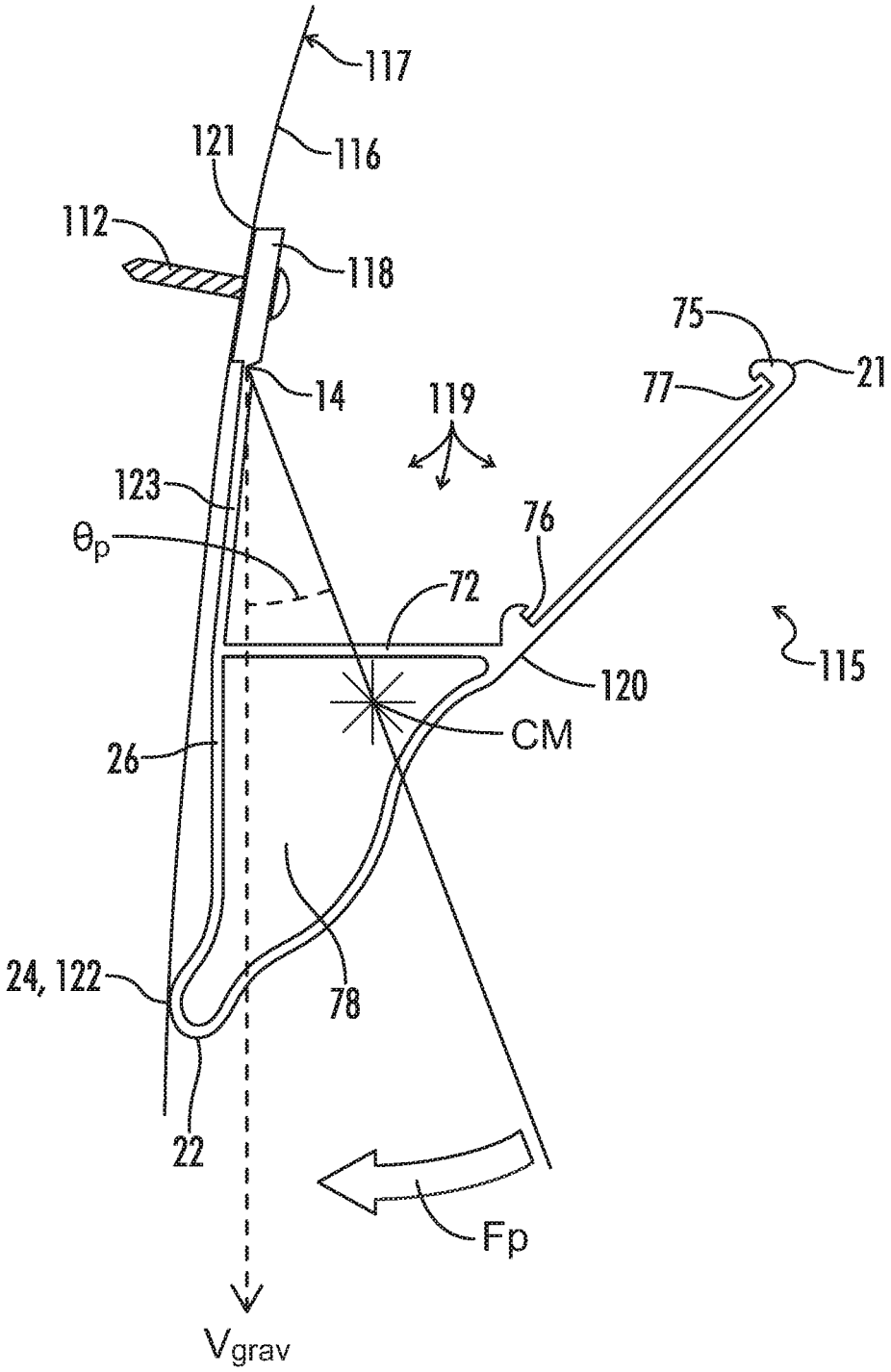
FIG. 16 is a side diagrammatic view of another embodiment of the crown molding assembly of the present invention, illustrating attachment to a curved wall.
Figure 17:
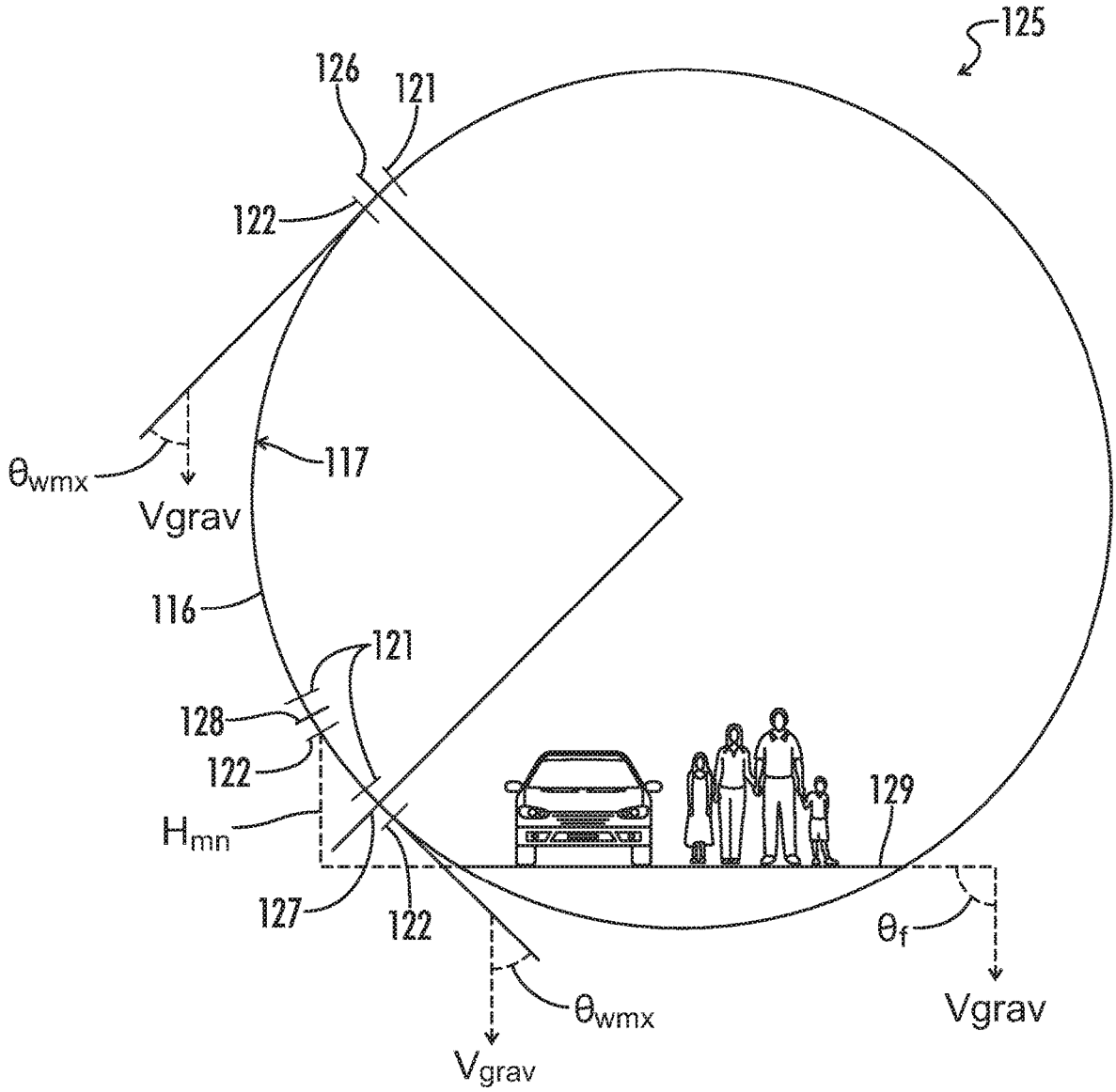
FIG. 17 is a side diagrammatic view of an example circular bore tunnel illustrating wall-defining parameters.

FIGS. 16-24 illustrate several additional embodiments and features of the present invention. Referring in particular to FIGS. 16 and 17, an embodiment of the present invention is illustrated along with adaptations for and illustrations of its deployment within a transportation tunnel, such as is commonly deployed underground whether for pedestrian, automobile, rail or any combination of uses.

It may be helpful to define some terms as used in this application to assist in understanding and clearly defining the present and later embodiments of the present invention. "Vgrav" is defined as the vector of the earth's gravity. Vgrav points in the direction of the dominant gravitational force, and is used as the root of all relative directional references. For example, up and down are defined as they exist with respect to Vgrav, as well as providing an absolute reference, when included in the figures, for top, bottom, above, below and the like. Where the absolute position is important within a figure, Vgrav will be included to anchor the reader to an absolute orientation of the system. "CM" is defined herein as the center of mass, when viewed in profile, of a pivoting body of a preferred embodiment of the present invention.

"θ" is used herein to refer to various angles which can help illustrate these preferred embodiments. Angles θ are created with respect to Vgrav, such that they are clearly directionally defined. "θp" is defined herein as the angle between a pivoting object's CM and Vgrav. In particular, for the embodiment illustrated in FIGS. 16 and 17, θp is defined as having a positive value when CM of the pivoting body is on the side of Vgrav, when viewed in profile, of upper point 21 of structure 115. θp is defined as a negative angle when CM is on the side of Vgrav opposite 21, or towards the interior of wall 116 as illustrated in FIG. 16. "θf" is used herein to support the absolute definition of floor 129 in FIG. 17 as horizontal. "θwmx" is used herein to describe the upper and lower limits of wall 116 within circular bore tunnel 125. "θw" is used herein to refer to the angle of any wall to Vgrav.

Figure 18:
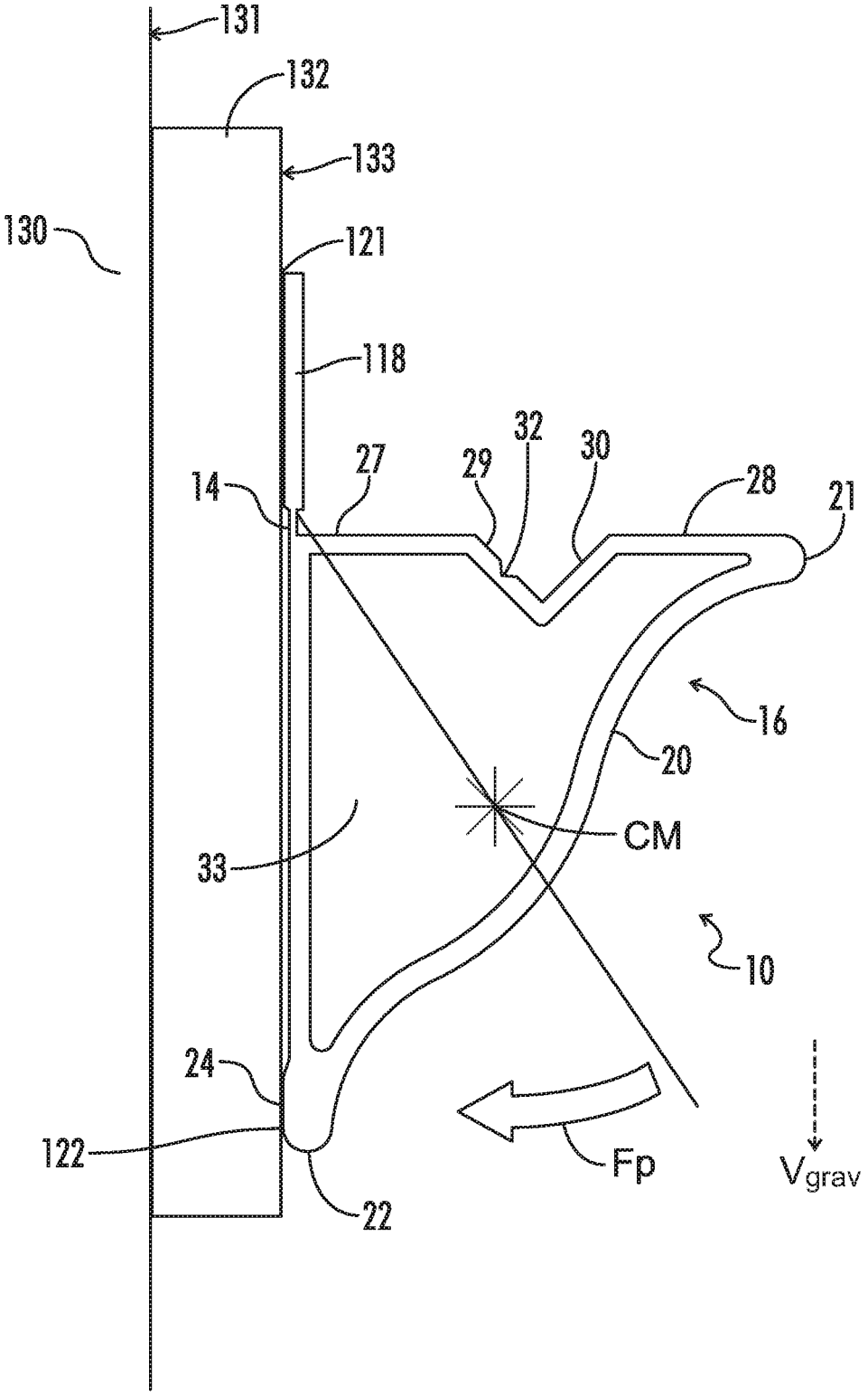
FIG. 18 is a side diagrammatic view of the crown molding section shown in FIG. 1 illustrating indirect attachment to a wall.
Figure 20:
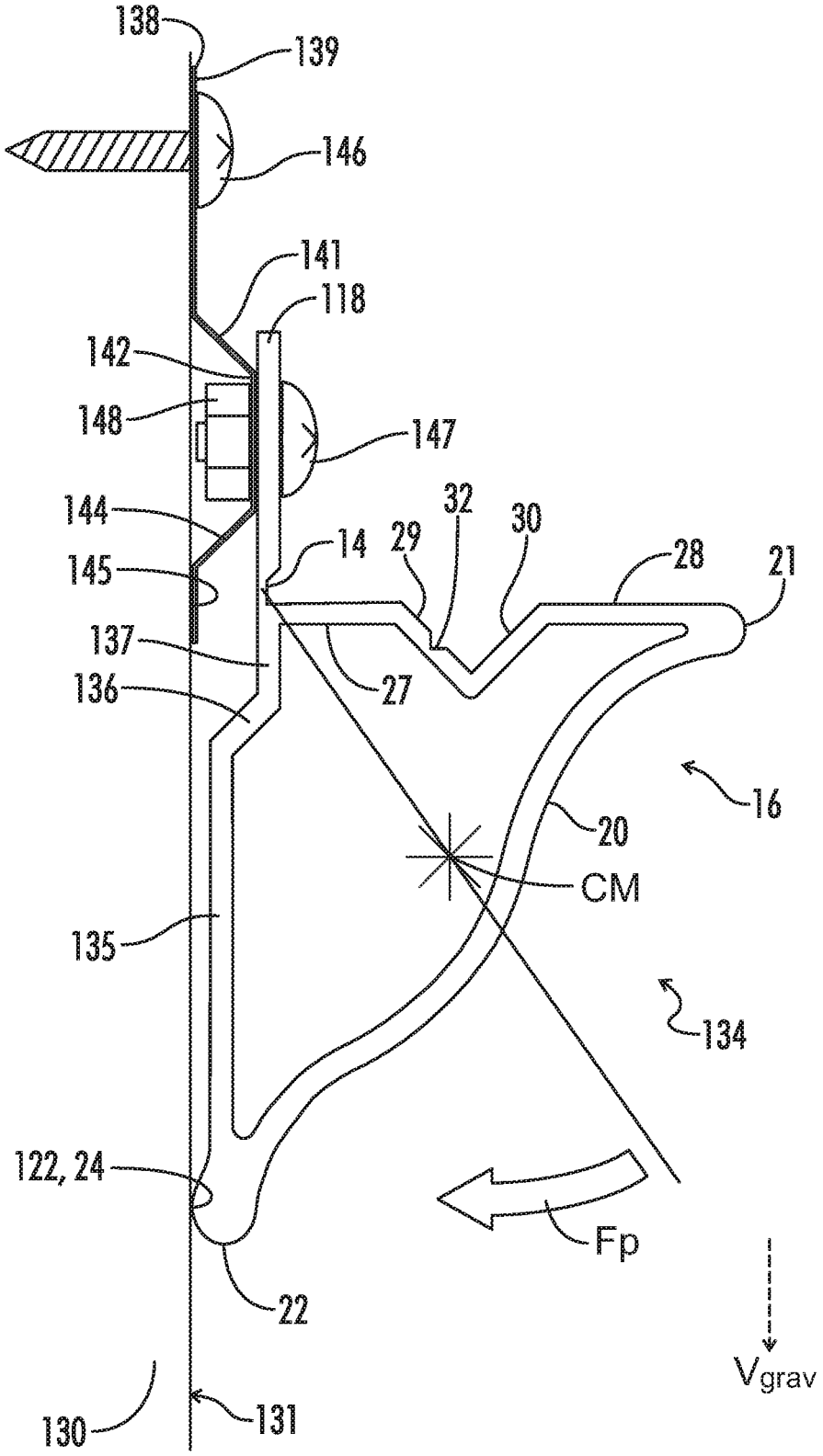
FIG. 20 is a side diagrammatic view of another embodiment of the present invention employing a mounting structure for a different installation means.

"Fp" as used herein describes the force generated by the pendulum effect within an embodiment of the present invention and is illustrated in FIGS. 16, 18 and 20. "Hmn" is used herein to describe the minimum height of the present invention.

FIG. 16 illustrates modifications to an embodiment of the present invention illustrated in FIGS. 8 and 9. Similarly numbered elements in FIG. 8 are similar in purpose and structure to those described previously. Wall attached structure 115 is derived from molding section 70 as illustrated in FIGS. 8 and 9 and is comprised of three main portions when viewed in profile as in FIG. 16, namely rigid attachment portion 118, which is securely affixed to tunnel wall 116 at surface 117, rigid pivoting portion 119 having a center of mass CM which must be positioned below rigid attachment portion 118, and a hinge portion 14 which flexibly connects rigid attachment portion 118 to rigid pivoting portion 119. Pivoting portion 119 is comprised of all structural components of structure 115 which are directly or indirectly connected to the opposite side of hinge 14 from attachment portion 118. All of the components of rigid pivoting portion 119 of wall attachment structure 115 are formed such that the components of portion 119 remain preferentially straight and positioned in profile consistent with the profile illustrated in FIG. 16, even as hinge portion 14 is structurally flexible. Further, the entirety of structure 115, as viewed in profile in FIG. 16, is unitary and produced for this embodiment using a known process such as extrusion or other processes such as pultrusion. The resulting three main portions of structure 115 have different properties with respect to flexibility, in particular, attachment portion 118 and pivoting portion 119 are preferentially stiff, even as hinge 14 is preferentially flexible. Using the capabilities known in the art of extrusion and pultrusion, such as co-extrusion of different materials within one piece with a unitary profile, or variability of the fibers within a pultruded piece, or any other variations known in the art, will produce a structure 115 whose hinge portion 14 is preferentially flexible with respect to both attachment portion 118 and pivoting portion 119. The relative stiffness of attachment portion 118 with respect to hinge portion 14 stands in contrast to the attachment portion 12 described in previous embodiments of the present invention.

Whereas the previous embodiments described attaching a crown molding to an irregular wall, where a finished appearance of the resulting installed crown molding was of importance, this embodiment of the present invention for purposes of illustration installs a structure within a transportation tunnel, where both the anticipated consistency of the wall to which structure 115 is attached is increased (reinforced concrete will not settle and distort over time the same way a standard wood stud wall in a residential building would be expected to) and the importance of the appearance of the junction between structure 115 and the tunnel wall surface 117 is reduced within the setting of a roadway or rail transportation tunnel wall. The core concepts of the present invention remain, in that when the longitudinally extending attachment portion 118 is secured to tunnel wall 116 with an appropriate fastener 112, the longitudinally extending flexible hinge portion 14 enables structure 115 to act as a simple pendulum system, where a securely attached portion 118 enables hinge 14 to act as a pivot such that pivoting portion 119 can swing or pivot about a pivot point of the hinge portion 14 and act as a single pivoting body 119 whose center of mass CM will always exert a force Fp to move the CM of 119 until it is directly below the pivot, which is hinge 14. As long as the CM of pivoting body 119 is outwardly spaced from wall surface 117 and toward the center of the space within which structure 115 is installed with respect to Vgrav such that θp is >0 degrees, then Fp will result and will continually urge wall contact surface 24 of pivoting portion 119 towards wall surface 117.

FIG. 16 further illustrates that member 123 of pivoting body 119 of wall attached structure 115 has been adapted to suit the curvature of wall 116 of the exemplary circular bore tunnel 125. Member 123 extends from where it starts at the junction of members 26, 72 and 123 up to where it ends at, and connecting to, hinge 14. Pivoting portion 119 of wall attached structure 115, when viewed in profile as in FIG. 16, has a room facing surface 120 which starts at top location 21 and proceeds continuously to bottom location 22.

Rigid attachment portion 118 of structure 115 as illustrated in FIG. 16 is attached securely to surface 117 of wall 116 of circular bore tunnel 125. The upper-most point of attachment portion 118 which contacts wall surface 117 is also the upper-most point of wall attached structure 115 which contacts the wall, and is identified as upper contact point 121 in FIGS. 16 and 17. Lower wall contact surface 24 of pivoting body 119 in FIG. 16 is also the lower-most contact point of structure 115 with wall surface 117, and is identified as lower contact point 122 in FIGS. 16 and 17. Lower contact point 122 is used to determine the minimum height Hmn of wall attached structure 115. Hmn is set for this and all embodiments as a minimum of 5' of vertical height from the floor of the space within which wall attached structure 115 is to be installed, measured to the lowest point of contact between the wall attached structure and the wall. As illustrated in FIG. 17, even if the floor is not directly beneath the wall attached structure, the height above the floor for the space within which wall attached structure 115 is where Hmn is measured from.

Circular bore tunnel wall 116 is illustrated in FIGS. 16 and 17 and has a surface 117 which is exposed to the interior of the tunnel. Wall 116 is reinforced concrete, smooth and lining the entire bore of the tunnel as is common in circular bore transportation tunnels. Surface 117 of tunnel wall 116 is smooth, as is the practice with reinforced concrete which is commonly deployed in transportation tunnels. FIG. 17 illustrates one example of a circular bore tunnel 125 as might be used for vehicular traffic. Illustrations of a typically sized automobile as well as a typically sized family indicate the scale of example circular bore 125 in FIG. 17. Circular bore tunnels are commonly used for various transportation purposes, and start from a circular bore which is created by a tunnel boring machine which, as is common in the tunneling arts, leaves behind a tunnel whose circular shape matches the circular cutting head of the boring machine which creates the tunnel. It is also common practice to line the walls of the circular bore with reinforced concrete, although there are other methods which may be employed. The example tunnel in FIG. 17 is lined with reinforced concrete and also includes a floor 129, which is filled in from the bottom with respect to Vgrav of tunnel 125 such that floor 129 is horizontal, and of-between Vgrav and floor 129 is equal to 90 degrees.

FIG. 17 also illustrates the definition of wall 116 and wall surface 117 as used in this application, which is helpful in a circular bore structure such as tunnel 125 where there is no apparent border defining walls, such as a ceiling or floor junction at 90 degrees as is present in most buildings. For the purposes of the present invention a wall is defined by the angle created between a straight line drawn between upper contact point 121 and lower contact point 122, as viewed in profile as in FIG. 17, which continues through 122 to create a straight line whose angle with respect to Vgrav can be measured. Note that the angle for a vertical straight wall as illustrated in several embodiments of the present invention, is 0 degrees, and as such meets this definitional requirement. θwmx is the maximum angle between a straight line through points 121 and 122 to be defined as a wall for the purposes of the present invention, and is 45 degrees, as illustrated in FIG. 17. Thus, for example, circular bore tunnel 125 position 126 represents the highest point of wall 116, and 127 represents the lowest point of wall 116. The same calculations and results apply to each side of tunnel 125. In addition to meeting the angular requirements above, in order to be defined as a wall the structure to which the wall attached structure is to be secured must itself be secured within the space. In the example illustrated in FIG. 17 of a reinforced concrete wall lining a tunnel, wall 116 is itself secured within the space (tunnel) within which the wall attached structure is to be deployed. This additional requirement ensures that when a wall attached structure of the present invention is installed on a wall as defined here, it is also secured within the space it serves.

Even with a wall defined as above, it is not the case that every position that is defined as wall is suitable for installation and function of wall attached structure 115. In addition to requiring installation to a wall as described above, any installation of wall attachment structure 115 must also meet the minimum height requirement of 5 feet from the floor of the space within which structure 115 is to be installed and lower contact point 122 of structure 115. As illustrated in FIG. 17, although position 127 meets the definition of a wall as defined for the present invention, position 127 does not meet the minimum height requirement, and Hmn determines that position 128 is in fact the lowest position on wall 116 of example circular bore tunnel 125 for installation and use of the present invention. Note that a significantly larger bore tunnel, such as for an eight-lane wide Interstate highway, may have a lowest defined wall position that is above the minimum height position.

An additional constraint exists at the upper end of wall 116. In order for the pendulum effect to generate a Fp which will reinforce the placement of lower wall contact surface 124 against wall surface 117, θp must be positive as illustrated in FIG. 16, when wall attachment structure 115 is in its intended position against wall 116. If wall attached structure 115 as illustrated in FIG. 16 were to be installed at wall position 126 as illustrated in FIG. 17, then θp would be negative, meaning that the CM of pivoting body 119 would be on the wall side of Vgrav, or the opposite of Vgrav as that pictured in FIG. 16. In that instance, Fp would be constantly pulling lower contact surface 24 away from wall surface 117, and would do so until the CM of pivoting portion 119 of structure 115 was directly under hinge 14. Therefore, the present invention must be installed such that θp is positive, which generates a Fp which continually urges lower contact point 122 against wall surface 117.

Now referring in particular to FIG. 18, the crown molding section 10 of FIGS. 1-3 is illustrated with one adaptation, replacing flexible attachment portion 12 with rigid attachment portion 118. Apart from the adaptation to the attachment portion, the other components of molding section 10 are as previously described. No fastener is illustrated in FIG.

18; however, rigid attachment portion 118 may be attached to surface 133 of spacing board 132 using a piercing fastener, a strong adhesive, or any other method known in the art, as long as the attachment is strong and secure enough to support the entirety of molding section 10 as viewed in profile in FIG. 18. Spacing board 132 is a board to which molding section 10 is directly attached, where the spacing board 132 is securely installed to surface 131 of room wall 130. Therefore, molding section 10 as illustrated in FIG. 18 is indirectly attached to wall 130, yet because spacing board 132 is securely attached to wall 130 and meets the wall defining angle requirements between upper contact surface 121 and lower contact point 122 described previously ($\theta w=0$ degrees $<\theta wmx$) spacing board 132 meets the requirements of a wall, for the purposes of installation of the present invention. Note that the CM of molding section 10 is spaced below and outwardly from hinge 14 with respect to Vgrav and the generated Fp will reinforce the position of contact surface 24 against surface 133 of spacing board 132. Although Hmn is not shown in FIG. 18, as long as lower contact 122 is higher than 5 feet off the floor, that requirement is also met.

Figure 19:
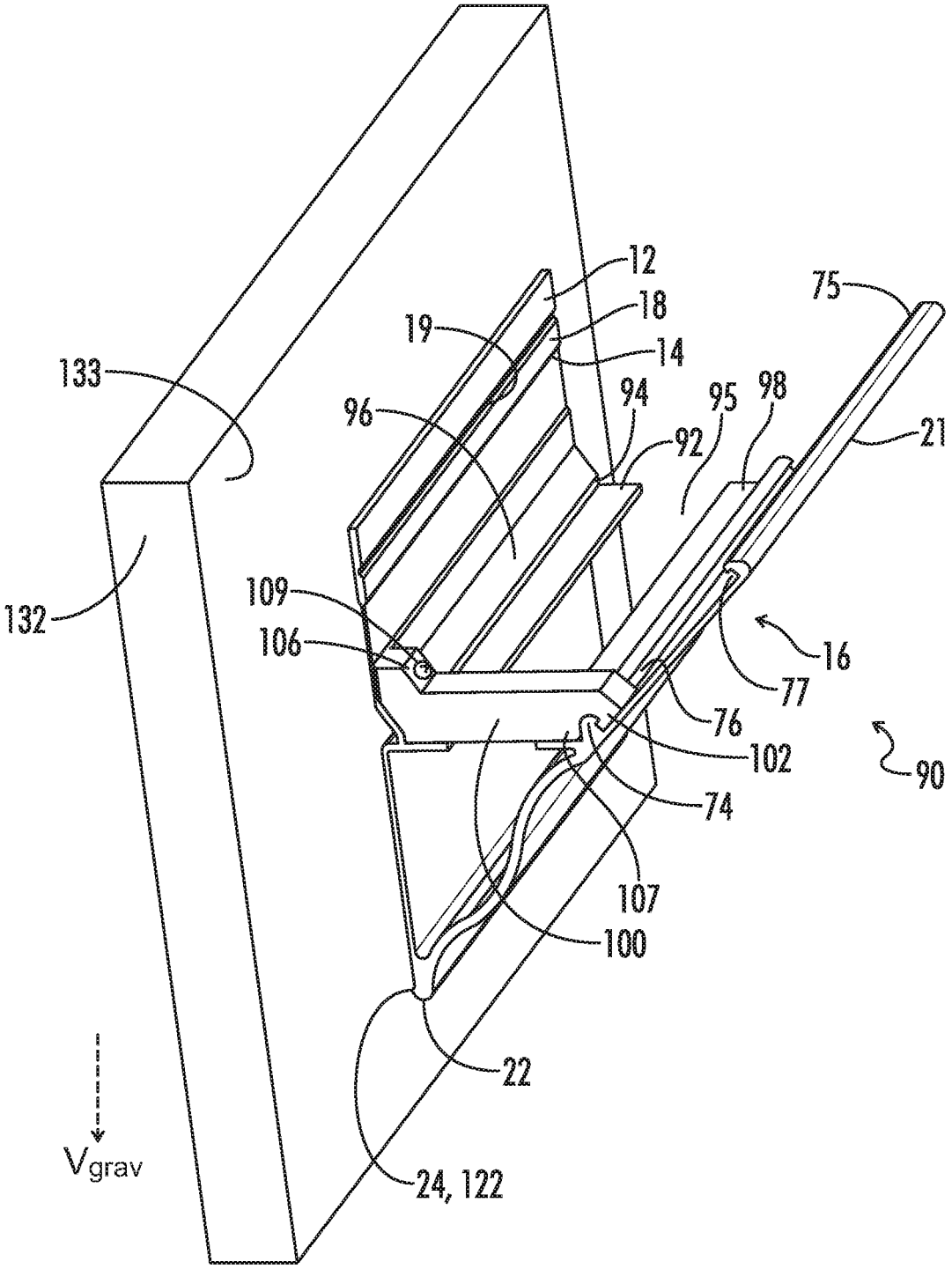
FIG. 19 is a perspective view of the crown molding section shown in FIG. 10 illustrating indirect attachment to a wall.

Now referring in particular to FIG. 19, crown molding section 90 of FIGS. 10-12 is illustrated against surface 133 of a spacing board 132. No wall 130 is illustrated; however, similar to the indirect installation of molding section 10 to spacing board 132 as illustrated in FIG. 18, as long as the attachment portion 12 is securely adhered or otherwise secured to surface 133 of spacing board 132 and spacing board 132 is securely affixed to the building structure and secured within the space and lower contact 122 is higher than five feet above the floor of the space, then molding section 90 is satisfactorily installed with respect to the requirements for the present invention.

Figure 21:
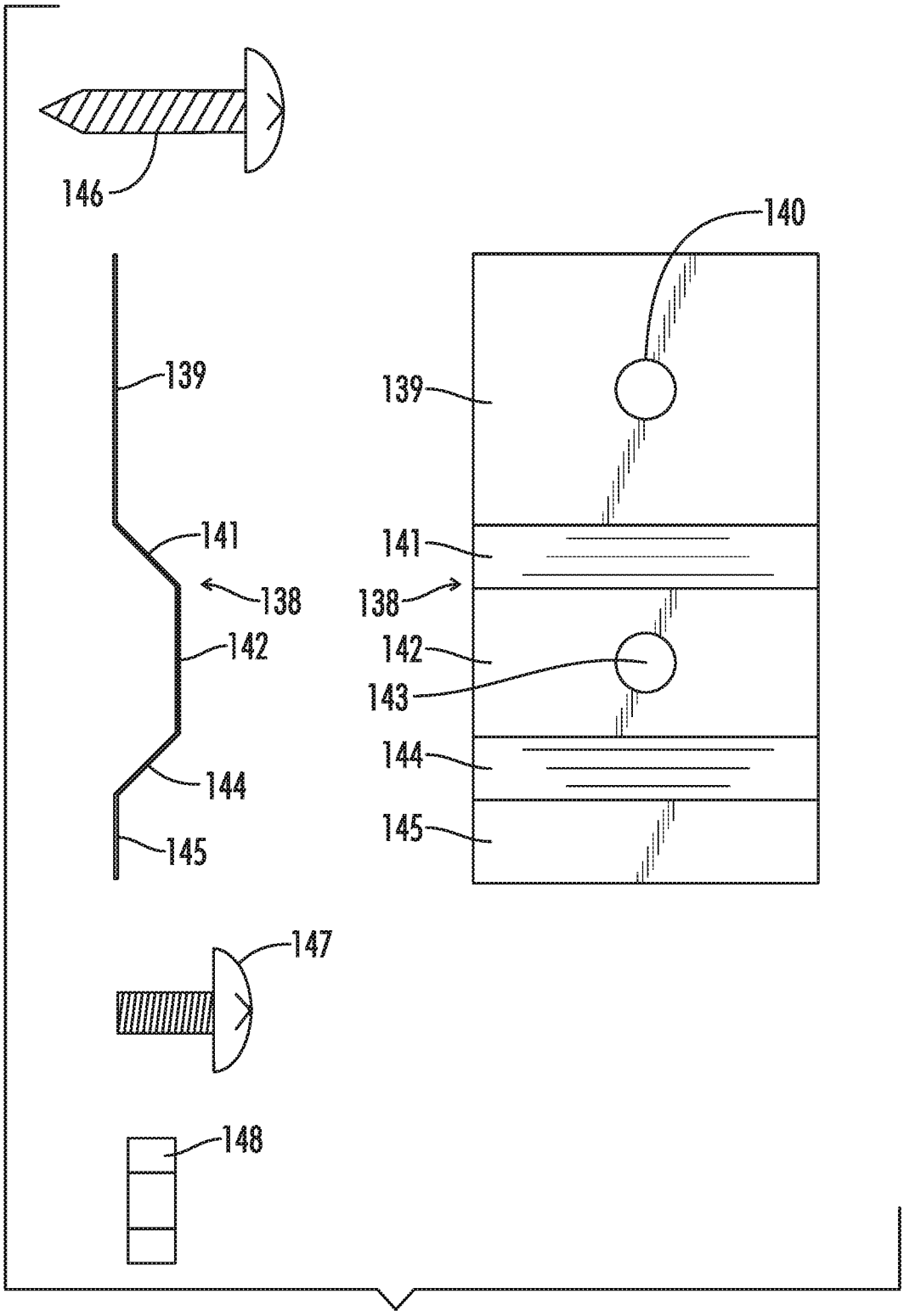
FIG. 21 is a side and front diagrammatic view of the components and fasteners of the mounting structure shown in FIG. 19.

FIGS. 20 and 21 illustrate another preferred embodiment of the present invention where the wall penetrating fastener normally used to secure the attachment portion of an embodiment of the present invention to the wall is shifted higher on the wall through a means of indirectly securing the installation portion to wall 130 and using a strong bracket to shift the penetrating fastener location higher on the wall while the crown molding itself remain lower on the wall.

Crown molding section 10 of FIGS. 1-3 is modified replacing flexible attachment portion 12 with rigid attachment portion 118 and shifting that attachment portion away from wall 130. The resulting molding section 134 is largely similar to molding section 10, with similar numbers serving similar functions as previously described and modifications described here. The rear member has been modified into several components to facilitate the offset attachment portion. Rear member 135 proceeds upwards from lower contact surface 24 spaced a consistent and small distance from wall surface 131 until it terminates at the bottom, with respect to Vgrav, of offset transition member 136, which proceeds upwards from 135 and farther away from wall surface 131 until it ends at final offset rear member 137. Final offset rear member 137 proceeds vertically, as viewed in profile in FIG. 20, a short distance until it terminates where it meets a shortened horizontal member 27 and the bottom of flexible hinge 14. On the opposite side of hinge 14 from pivoting portion 16 of molding section 10 is rigid attachment portion 118.

FIG. 21 illustrates the offset hardware for this preferred embodiment of the present invention. Offset plate 138 is made from a strong, rigid material such as stamped steel, which is bent into the shape illustrated in profile and head on in FIG. 21. Surface attachment portion 139 contains a fastener hole 140 through which piercing fastener 146 can be driven into wall 130, securing offset plate 138 to wall 130. Upper offset transition section 141 of offset plate 138 travels from the bottom, with respect to Vgrav in FIG. 20, of attachment portion 139 and travels away from wall surface 131 until it meets vertical molding attachment portion 142 which contains fastener hole 143 and travels parallel to wall surface 131 until it terminates at the upper edge of lower offset transition section 144 which travels towards wall surface 131 until it terminates at the upper edge of wall resting portion 145 of offset plate 138.

Piercing fastener 146 first secures offset plate 138 to wall 130 piercing wall 130 above where a fastener through installation portion 12 of an un-modified molding section 10 to be installed at the same height would otherwise pierce wall 130. This offset can be useful if there is known to be an obstacle such as a water pipe travelling longitudinally within wall 130 at that height, and offset plate 138 and molding section 134 can provide a solution. Offset plate 138 provides one example of the degree, or height of offset provided. Other embodiments or applications may call for a greater or lesser offset distance for the piercing fastener, which can be provided with an extended attachment portion 139 which extends higher up the wall with a corresponding fastener hole 140 as high relative to lower contact surface 24 of molding section 134 as desired.

Once as many offset plates 138 as are needed for the length of molding section 134 installation are securely installed, machine bolt 147 can be placed through a corresponding hole, drilled onsite if needed, through rigid attachment portion 118 of molding section 134 corresponding to every fastener hole 143 in every offset plate 138 needed for installation and tightened to nut 148 which secures rigid attachment portion 118 to molding attachment portion 142 of each offset plate 138. When molding section 134 is securely installed to offset plate 138 and offset plate 138 is securely fastened to wall 130, then resting portion 145 of offset plate 138 rests against wall surface 130 and maintains molding attachment portion 142 of offset plate 138 in position.

For this preferred embodiment of the present invention the top-most portion of attachment portion 139 serves as the upper contact portion (instead of 121 in other embodiments) and the same lower contact 122 serves to determine wall angle $\theta w$ as described above for wall definition and suitability. Note that the CM of pivoting body 16 of molding section 134 is below and spaced outwardly from hinge 14, and the resulting Fp will reinforce the desired position of lower contact surface 24 against wall surface 131. As long as lower contact 122 is located at least five feet above the floor of the space within which molding section 134 is installed, this preferred embodiment of the present invention meets all requirements.

Figure 22:
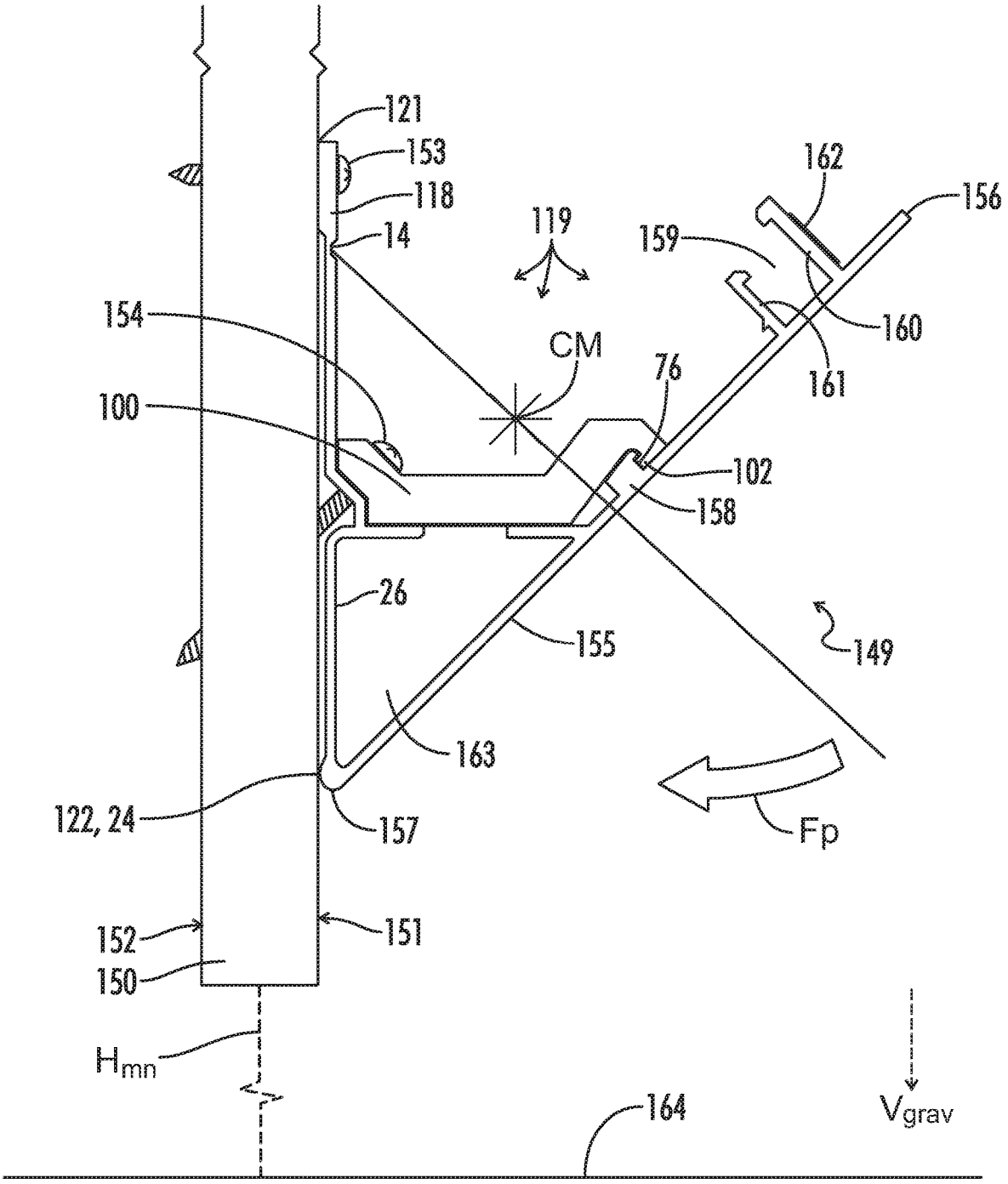
FIG. 22 is a side diagrammatic view of another embodiment of the present invention illustrating a structure devoid of decoration and supporting an LED light fixture and two compartments.

Referring now in particular to FIG. 22 wall attached structure 149 is illustrated installed to a member 150, where member 150 is securely affixed to a ceiling above the space within which structure 149 is to be installed. Member 150 meets the definition of a wall as previously described in that wall angle $\theta w$ of a straight line through upper contact 121 and lower contact 122 and Vgrav=0 degrees <45 degrees=$\theta wmx$ and ceiling secured member 150 is secured to a ceiling above using brackets or other methods known in the art which result in member 150 being secured to the building after installation of wall attached structure 149 against surface 151 of member 150 using primary fastener 153 as illustrated in FIG. 22. Further requirements defined for the present invention are also met in that ceiling secured member 150, at its lowest point with respect to Vgrav as illustrated in FIG. 22, is five feet above standard interior floor 164, indicated by Hmn. Since lowest contact 122 is some distance above the lowest point of member 150 as illustrated in FIG. 22, the illustrated installation meets the Hmn requirements of the present invention. The CM of pivoting body 119 of wall attached structure 149 also meets the requirements of the present invention as the CM is below and outwardly spaced from hinge 14 with respect to Vgrav as illustrated in FIG. 22.

Wall secured structure 149 is adapted from molding section 90 of a previously described preferred embodiment of the present invention, and illustrated in FIGS. 10-12. Number elements of structure 149 function similarly to their previously described form and function. All decorative elements are removed from room facing surface 155 such that room facing surface 155 consists of a flat plane when viewed in profile as in FIG. 22, starting at upper most point 156 and travelling in a flat plane until it terminates at lowest point 157. An upper compartment 159 is created between an upper member 160 protruding orthogonally from the rear of wall facing surface 155 when viewed in profile as in FIG. 22 and a lower member 161 protruding correspondingly from a position lower on the rear side of room facing surface 155. Upper compartment 159 runs longitudinally along the installed length of wall attached structure 149 and may be used to hold communications cables which are often required to be segregated from electrical power cables, which may be stored similarly in lower compartment 163.

Modified tab 158 is modified to conform to the rear side of room facing surface 155 while allowing use of an un-modified cross member 100 and whose slot 76 is configured to securely hold finger 102 of cross member 100, thereby reinforcing the designed position of room facing surface 155 with respect to rear member 26 and rigid attachment portion 118, where rigid attachment portion 118 is used to secure wall attached structure 149 to member 150 using primary fastener 153.

Although rigid attachment portion 118 replaces flexible attachment portion 12 of molding section 90 for this embodiment of the present invention, hinge 14 is similarly structurally flexible along its longitudinally extending pivot point and, as such, enables the intra-structural pendulum or pendulum effect within wall attached structure 149 whereby pivoting body 119, which is comprised of all components of wall attached structure 149 attached to the opposite side of hinge 14 from rigid attachment portion 118, to pivot as would a simple pendulum with a CM similarly positioned as illustrated in FIG. 22, generating an Fp which will continually urge lower wall contact surface 24 against member surface 151 of ceiling secured member 150. After rigid attachment portion 118 is securely affixed to member 150, which is itself securely attached to the building within which structure 149 is installed via the ceiling, by tightening primary fastener 153, the intra-structural pendulum or pendulum effect as described above will reinforce the designed position of lower contact surface 24 against wall surface 151 of member 150. Secondary fastener 154 serves as a means of locking pivoting body 119 into the designed position illustrated in FIG. 22. This may be useful in instances where the space within which wall installation structure 149 is installed is expected to significantly move, which could dislodge or otherwise disrupt the designed position of pivoting body 119. Examples include the rocking of a cruise ship in heavy seas, where the pendulum effect on a structure 149 installed within a cabin on that ship may rock sufficiently that the pendulum effect on CM could periodically dislodge pivoting body 119 from its designed location as θp changes in heavy seas. A seismic event such as an earthquake may cause similar disruptions when structure 149 is installed within a building experiencing an earthquake. Additionally, absent secondary fastener 154 unintended physical contact with pivoting body 119 of wall attached structure 149 could also temporarily and undesirably dislodge pivoting body 119. To prevent these disruptions a secondary fastener 154 can be employed as illustrated in FIG. 22 to lock pivoting body 119 of structure 149 in its designed location with lower contact surface 24 against member 150 surface 151.

Note that both primary fastener 153 and secondary fastener 154 protrude through rear surface 152 of ceiling secured member 150 when securing wall secured member 149 to member 150 as illustrated in FIG. 22. These fastener protrusions would ideally be obscured from view, likely by installing ceiling secured member 150 spaced outwardly from a wall of the room within which member 150 and structure 149 are installed, for example by 10 inches. A spacing of 10 inches would also allow for installation of curtains whereby the installation hardware and track for the curtains are conveniently hidden behind member 150, but without contacting either protruding fastener 153 or 154. In such an installation example the side of upper compartment 159 upper member 160 facing towards upper end 156 of room facing surface 155 may serve as the installation surface for a standard LED light strip 162, which can indirectly light a room within which this preferred embodiment of the present invention is installed.

With a standard LED light strip 162 installed to the upward facing side of upper compartment member 160, the wall installation structure 149 serves to support and position LED light strip 162 and, as such serves as a support structure for a lighting fixture. As noted above wall installation structure 149 is adapted to support two separate compartments, upper compartment 159 and lower compartment 163. Wall installation structure 149 therefore may be employed as a support structure for, and conveyance of, various electrical cables. Many electrical codes prohibit copper communications cables such as category Ethernet cables from being co-mingled with electrical power cables. As such upper compartment 159 is segregated from lower compartment 163, and may provide the necessary separation between Ethernet cables and electrical power cables.

Figure 23:
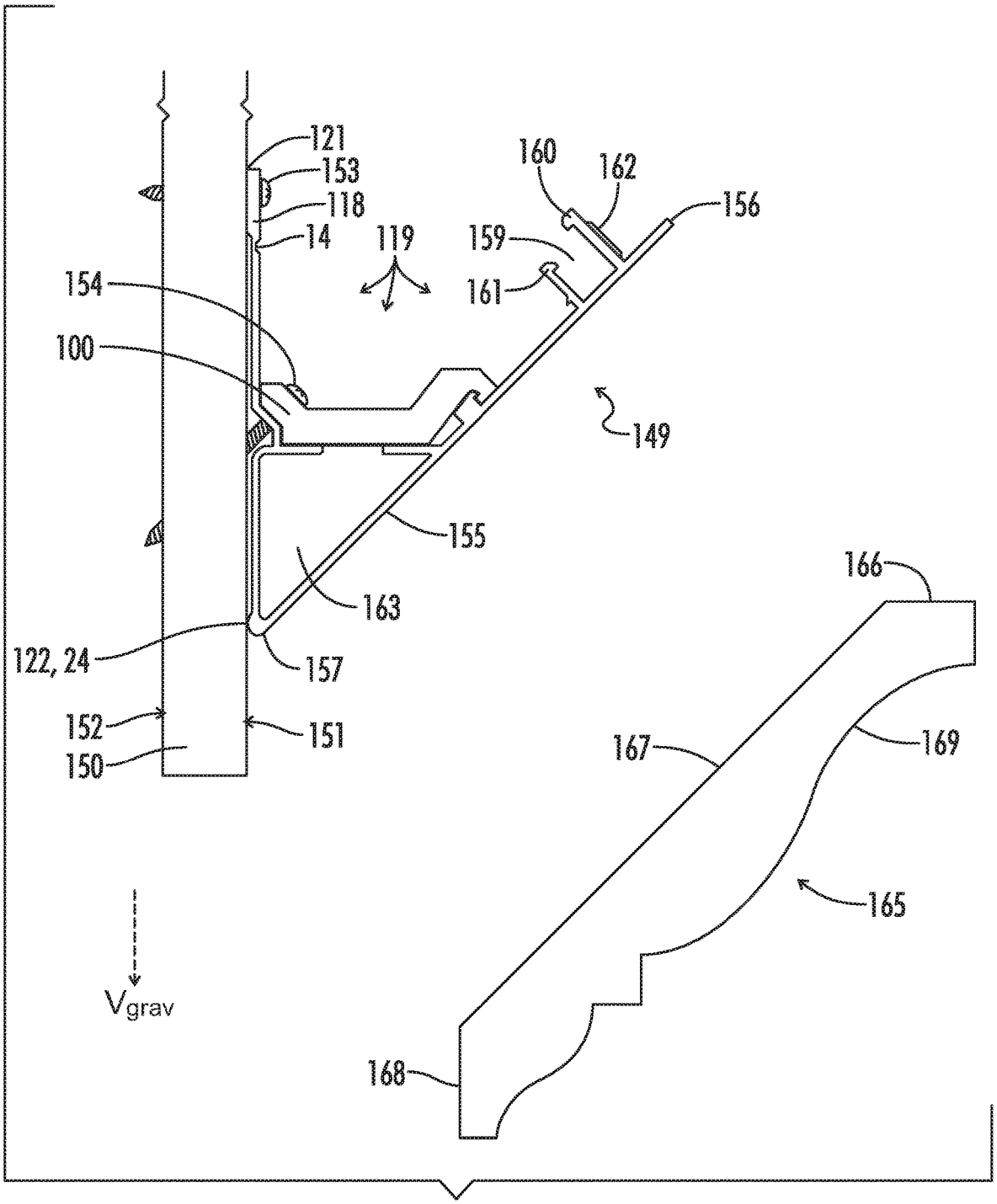
FIG. 23 is a side diagrammatic view of the wall attachment structure shown in FIG. 22 alongside a traditional crown molding section.
Figure 24:
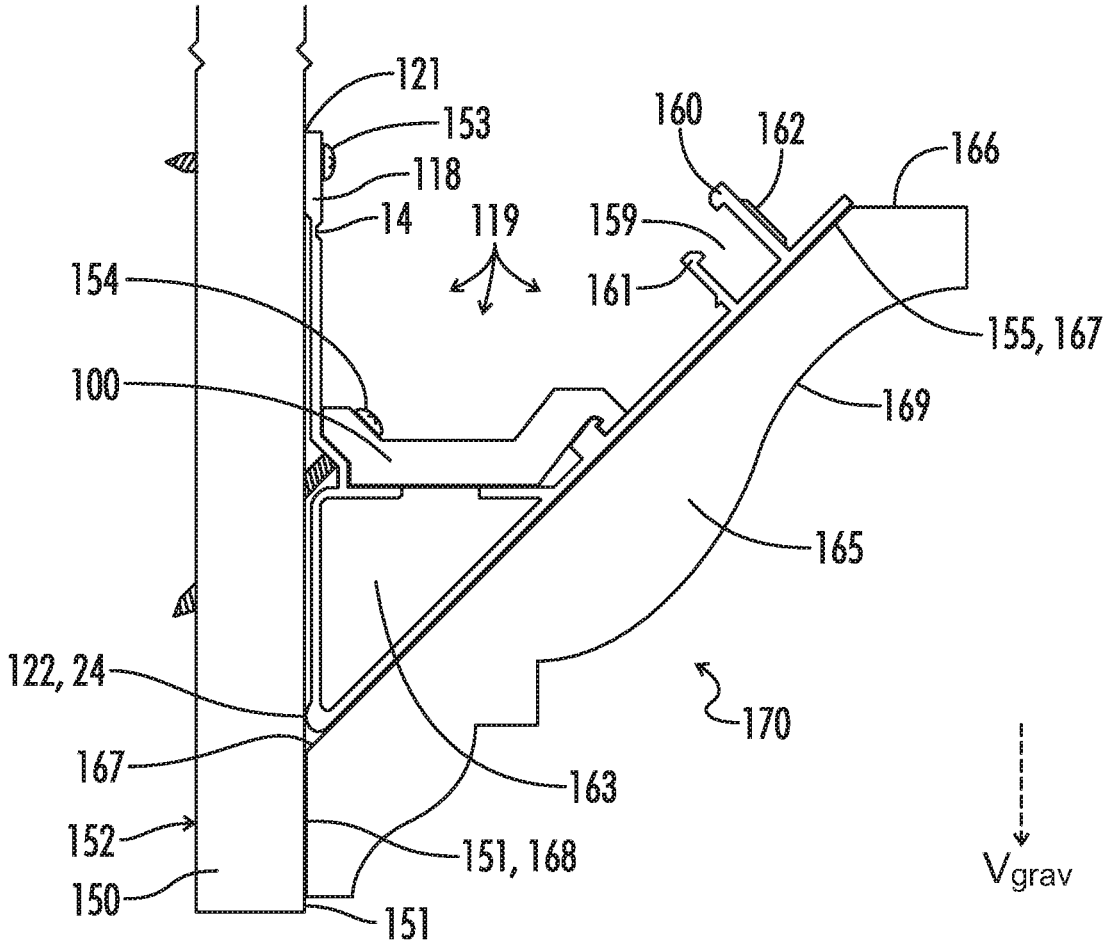
FIG. 24 is a side diagrammatic view of a combine structure of the wall attachment structure shown in FIG. 22 and the traditional crown molding shown in FIG. 23.

Referring now in particular to FIGS. 23 and 24 wall installation structure 149 is illustrated as a support structure for the installation of traditional crown molding 165. FIG. 23 illustrates wall installation structure 149 alongside a traditional crown molding 165. Crown molding 165 may be extruded foam as is commonly available, and has a decorative face 169 which is visible to the room after installation, and an upper horizontal flat surface 166, when viewed in profile as in FIG. 23 and with respect to Vgrav, and a lower vertical flat surface 168 and a rear flat surface 167 connecting 166 to 168. Rear surface 167 of crown molding 165 is angled so as to lay flat against room facing surface 155 of wall installation structure 149 such that when crown molding 165 is pressed against a securely installed structure 149 as illustrated in FIG. 23 crown molding rear surface 167 lays tightly against room facing surface 155 of 149 and vertical crown molding surface 168 lays directly against ceiling secured member 150 surface 151. This facilitates the secure installation of crown molding 165 to the room facing surface of wall installation structure 149 using in an embodiment a suitably strong adhesive between the mating surfaces. With rear crown molding surface 167 securely adhered to room facing surface 155 of 149, and lower vertical surface 168 placed directly against member 150 surface 151 (whether also adhered or not) the resulting combination structure 170, as illustrated installed against a ceiling secured member 150, appears to occupants in the room as a simple crown molding 165. In this preferred embodiment of the present invention wall installation structure 149 is itself a support structure for crown molding 165, as well as a support structure for LED light strip 162, upper compartment 159, lower compartment 163 and various electrical and communications cables, if desired. Combination structure 170, comprised of traditional crown molding 165 adhered or otherwise secured to wall installation structure 149 as illustrated in FIG. 24, provides substantially increased utility from a standard installation of crown molding 165 absent wall installation structure 149.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. As used throughout, ranges are used as shorthand for describing each and every value that is within the range. Any value within the range can be selected as the terminus of the range.

What is claimed is:

1. A wall attachment structure comprising:

a longitudinally extending attachment portion having an upper edge, a lower edge, a rearward facing wall contacting surface, and a short scale flex capability to facilitate secure attachment to an irregular wall surface;

a hinge portion extending longitudinally within or along the lower edge of the attachment portion; and a pivoting portion pivotally connected to the hinge portion or lower edge of the attachment portion, said pivoting portion including a lower wall contacting surface and having a center of mass which, when the attachment portion is secured to the wall surface, is positioned outwardly from and below the hinge portion, the hinge portion defining a pivot point enabling the pivoting portion as a pendulum and resulting in a force which continually urges the lower wall contacting surface into contact with the wall surface, the hinge portion preventing short scale flexing of the attachment portion from being transmitted to the pivoting portion.

2. The wall attachment structure of claim 1 additionally comprising a crown molding configured to be secured to a room facing surface of the pivoting portion.

3. The wall attachment structure of claim 2 in which the crown molding is comprised of an extruded foam material.

4. The wall attachment structure of claim 1 in which the pivoting portion has an inherent structure so as to remain preferentially straight when the attachment portion is secured to an irregular wall surface.

5. The wall attachment structure of claim 4 additionally comprising a lower compartment extending longitudinally in the pivoting portion, and an alignment insert, wherein the alignment insert is dimensioned to be received in the lower compartment to facilitate securing sections of the pivoting portion of the wall attachment structure together end-to-end.

6. The wall attachment structure of claim 5 additionally comprising first and second oppositely disposed notches on a surface of the pivoting portion, said notches configured for receiving an alignment tab for properly aligning adjacent sections of the wall attachment structure.

7. The wall attachment structure of claim 6 in which the center of mass of the pivoting portion is at a positive angle with respect to a vector of gravity when the attachment portion is properly secured to a wall surface.

8. The wall attachment structure of claim 7 in which the structure is intended to be secured to a wall surface at a minimum height of five feet.

9. The wall attachment structure of claim 8 additionally comprising an offset plate having a structure attachment portion and a wall surface attachment portion spaced apart from the structure attachment portion for securing the wall attachment structure to a wall at a location offset from the attachment portion.

10. The wall attachment structure of claim 4 additionally comprising segregated upper and lower compartments in the pivoting portion configured for separated conveyance of electrical cabling.

11. The wall attachment structure of claim 4 in which the pivoting portion additionally comprises a rear member extending downwardly to the lower wall contacting surface at a position spaced inwardly on the pivoting portion from the lower wall contacting surface.

12. The wall attachment structure of claim 11 in which the pivoting portion additionally comprises a decorative face, and a detachable reinforcing structural member securable between a rear leg of the pivoting portion located above the rear member and a rear surface of the decorative face.

13. The wall attachment structure of claim 1 in which the hinge portion is spaced inwardly from the wall contacting surface of the attachment portion.

14. A wall attachment structure comprising:

a longitudinally extending attachment portion configured for securing to vertical and nonvertical wall surfaces having a rearward facing wall contacting surface, an upper contact point, and a lower edge;

a hinge portion extending longitudinally along the lower edge of the attachment portion; and a pivoting portion pivotally connected to the hinge portion including a front face having an upper edge and a lower edge, a lower contact point, and having a center of mass which, when the attachment portion is secured to a wall surface, is positioned outwardly from and below the attachment portion, the hinge portion defining a pivot point for the pivoting portion enabling the pivoting portion as a pendulum and providing a force which continually urges the lower contact point in the direction of the wall surface until the center of mass is directly under the hinge portion.

15. The wall attachment structure of claim 14 in which the pivoting portion additionally comprises a rear member extending downwardly to the lower contact point and spaced inwardly on the pivoting portion from the lower wall contacting surface.

16. The wall attachment structure of claim 15 in which the center of mass of the pivoting portion is at a positive angle with respect to a vector of gravity when the attachment portion is properly secured to a wall surface.

17. The wall attachment structure of claim 16 in which the structure is intended to be secured to a wall surface at a minimum height of five feet.

18. The wall attachment structure of claim 14 additionally comprising an offset plate having a structure attachment portion and a wall surface attachment portion spaced apart from the structure attachment portion for securing the wall attachment structure to a wall at a location offset from the attachment portion.

* * * * *